US010743618B2

(12) United States Patent
Bruce et al.

(10) Patent No.: US 10,743,618 B2
(45) Date of Patent: Aug. 18, 2020

(54) HYBRID BRAIDED ARTICLE

(71) Applicant: NIKE, INC., Beaverton, OR (US)

(72) Inventors: Robert M. Bruce, Portland, OR (US); Eunice Kyung Lee, Beaverton, OR (US); Craig K. Sills, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 265 days.

(21) Appl. No.: 15/903,542

(22) Filed: Feb. 23, 2018

(65) Prior Publication Data

US 2018/0242689 A1 Aug. 30, 2018

Related U.S. Application Data

(62) Division of application No. 14/721,507, filed on May 26, 2015, now abandoned.

(51) Int. Cl.

| | |
|---|---|
| ***A43B 23/02*** | (2006.01) |
| ***A43B 23/04*** | (2006.01) |
| ***D04C 1/06*** | (2006.01) |
| ***A43B 1/04*** | (2006.01) |
| ***D04C 1/08*** | (2006.01) |
| ***D04C 3/48*** | (2006.01) |

(52) U.S. Cl.

CPC ..... *A43B 23/0245* (2013.01); *A43B 1/04* (2013.01); *A43B 23/0205* (2013.01); *A43B 23/042* (2013.01); *D04C 1/06* (2013.01); *D04C 1/08* (2013.01); *D04C 3/48* (2013.01); *D10B 2501/043* (2013.01)

(58) Field of Classification Search

CPC ..... A43B 1/04; A43B 23/0245; D04C 1/06; D04C 1/08; D04C 3/48

See application file for complete search history.

(56) References Cited

U.S. PATENT DOCUMENTS

| | | | | |
|---|---|---|---|---|
| 165,941 | A | 7/1875 | Malhebe | |
| 329,739 | A | 11/1885 | Henkels | |
| 376,372 | A | 1/1888 | Dodge | |
| 509,241 | A | 11/1893 | Paokaed | |
| 586,137 | A | 7/1897 | Medger | |
| 621,922 | A | 3/1899 | Kelsall | |
| 972,718 | A * | 10/1910 | Rahm | D04C 1/06 87/11 |

(Continued)

FOREIGN PATENT DOCUMENTS

| | | |
|---|---|---|
| BE | 426458 A1 | 3/1938 |
| CN | 86209002 U | 10/1987 |

(Continued)

OTHER PUBLICATIONS

Non-Final Office Action received for U.S. Appl. No. 15/993,180, dated Apr. 6, 2020, 13 pages.

(Continued)

*Primary Examiner* — Shaun R Hurley

(74) *Attorney, Agent, or Firm* — Shook, Hardy and Bacon LLP

(57) ABSTRACT

An upper for an article of footwear is formed by incorporating different braided portions. The upper may be formed by incorporating a first braided portion with a second braided portion. The top portion of the upper may have the first braided portion. The lower portion of the upper may have the second braided portion.

5 Claims, 14 Drawing Sheets

(56) References Cited

U.S. PATENT DOCUMENTS 1,182,325 A 5/1916 Sedmak
1,318,888 A 10/1919 Le Carpentier
1,527,344 A 2/1925 Bente et al.
1,538,160 A 5/1925 Bosebeck
1,540,903 A 6/1925 Santoyo
1,554,325 A 9/1925 Bente
1,583,273 A 5/1926 Bosebeck
1,597,934 A 8/1926 Stimpson
1,600,621 A 9/1926 Buek, Jr.
1,622,021 A 3/1927 Birkin et al.
1,637,716 A 8/1927 Turck
1,663,319 A 3/1928 Snell
1,687,643 A 10/1928 Berliner
1,713,307 A 5/1929 Stritter
1,717,183 A 6/1929 Brenner
1,730,768 A 10/1929 Heyman
1,803,554 A 5/1931 Knilans
1,828,320 A 10/1931 Daniels
1,832,691 A 11/1931 David
1,864,254 A 6/1932 Meyer
1,877,080 A 9/1932 Teshima
1,887,643 A 11/1932 Huber
1,949,318 A 2/1934 Markowsky
D91,999 S 4/1934 Heilbrunn
2,001,293 A 5/1935 Wilson
2,022,350 A 11/1935 Huber
2,091,215 A 8/1937 Price
2,144,689 A 1/1939 Roberts
2,147,197 A 2/1939 Glidden
2,161,472 A 6/1939 Hurwit
2,162,472 A 6/1939 Scharf
2,165,092 A 7/1939 Daniels
2,188,640 A 1/1940 Bloch et al.
RE21,392 E 6/1940 Hurwit
2,271,888 A 2/1942 Manley
2,311,959 A 2/1943 Nurk
D137,767 S 4/1944 Goldstein
2,382,559 A 8/1945 Goldstein
2,412,808 A 12/1946 Goldstein
2,521,072 A 9/1950 Lovell
D164,847 S 10/1951 Dronoff
2,586,045 A 2/1952 Hoza
2,617,129 A 11/1952 Petze
2,641,004 A 6/1953 Whiting et al.
2,675,631 A 4/1954 Doughty
2,679,117 A 5/1954 Reed
2,701,887 A 2/1955 Nolan
2,936,670 A 5/1960 Walter
3,052,904 A 9/1962 Reid et al.
3,081,368 A 3/1963 Wunsche
3,257,677 A 6/1966 Batchelder et al.
3,282,757 A 11/1966 Brussee
3,397,847 A 8/1968 Thaden
3,474,478 A 10/1969 Rubico et al.
3,504,450 A 4/1970 Steadman et al.
3,525,110 A 8/1970 Rubico et al.
3,586,058 A 6/1971 Ahrens et al.
3,619,838 A 11/1971 Winkler
3,714,862 A * 2/1973 Berger ..... D04C 1/08 87/8
3,745,600 A 7/1973 Rubico et al.
3,805,667 A 4/1974 Orser
3,821,827 A 7/1974 Nadler
3,866,512 A * 2/1975 Berger ..... D04C 1/08 87/37
4,134,955 A 1/1979 Hanrahan, Jr. et al.
4,149,249 A 4/1979 Pavkovich
4,194,249 A 3/1980 Thorneburg
4,222,183 A 9/1980 Haddox
4,232,458 A 11/1980 Bartels
4,275,638 A 6/1981 DeYoung
4,341,097 A 7/1982 Cassidy et al.
4,351,889 A 9/1982 Sundberg
4,394,803 A 7/1983 Goldstein
4,430,811 A 2/1984 Okada
4,447,967 A 5/1984 Zaino
4,519,290 A 5/1985 Inman et al.
4,587,749 A 5/1986 Berlese
4,591,155 A 5/1986 Adachi
4,629,650 A 12/1986 Kataoka
4,640,027 A 2/1987 Berlese
4,662,088 A 5/1987 Autry et al.
4,719,837 A 1/1988 McConnell et al.
4,785,558 A 11/1988 Shiomura
4,800,796 A * 1/1989 Vendramini ..... B27F 1/06 87/5
4,847,063 A 7/1989 Smith
4,848,745 A 7/1989 Bohannan et al.
4,857,124 A 8/1989 Shobert et al.
4,879,778 A 11/1989 Becka et al.
4,882,858 A 11/1989 Signori
4,885,973 A 12/1989 Spain
4,916,997 A 4/1990 Spain
4,919,388 A 4/1990 Koike et al.
4,939,805 A 7/1990 Walega
4,974,275 A 12/1990 Backes et al.
4,976,812 A 12/1990 McConnell et al.
4,992,313 A 2/1991 Shobert et al.
5,001,961 A 3/1991 Spain
D315,823 S 4/1991 Signori
5,067,525 A 11/1991 Tsuzuki et al.
5,121,329 A 6/1992 Crump
5,201,952 A 4/1993 Yahagi et al.
5,203,249 A 4/1993 Adams et al.
5,257,571 A 11/1993 Richardson
5,287,790 A 2/1994 Akiyama et al.
5,335,517 A 8/1994 Throneburg et al.
5,344,315 A 9/1994 Hanson
5,345,638 A 9/1994 Nishida
5,348,056 A 9/1994 Tsuzuki
5,361,674 A 11/1994 Akiyama et al.
5,381,610 A 1/1995 Hanson
5,385,077 A 1/1995 Akiyama et al.
5,388,497 A 2/1995 Akiyama et al.
5,396,829 A 3/1995 Akiyama et al.
5,398,586 A 3/1995 Akiyama et al.
5,439,215 A 8/1995 Ratchford
5,476,027 A 12/1995 Uchida et al.
5,647,150 A 7/1997 Romanato et al.
5,732,413 A 3/1998 Williams
5,885,622 A 3/1999 Daley
5,896,758 A 4/1999 Rock et al.
5,901,632 A 5/1999 Ryan
6,024,005 A 2/2000 Uozumi
6,029,376 A 2/2000 Cass
6,205,683 B1 3/2001 Clark et al.
6,298,582 B1 10/2001 Friton et al.
6,308,536 B2 10/2001 Roell
6,345,598 B1 2/2002 Bogdanovich et al.
6,401,364 B1 6/2002 Burt
6,451,046 B1 9/2002 Leo et al.
6,482,492 B1 11/2002 Hung
6,510,961 B1 1/2003 Head et al.
6,588,237 B2 7/2003 Cole et al.
6,679,152 B1 1/2004 Head et al.
6,696,001 B1 2/2004 Quddus
6,826,853 B1 12/2004 Zanatta
6,910,288 B2 6/2005 Dua
6,931,762 B1 8/2005 Dua
6,945,153 B2 9/2005 Knudsen et al.
6,971,252 B2 12/2005 Therin et al.
7,004,967 B2 2/2006 Chouinard et al.
7,047,668 B2 5/2006 Burris et al.
7,093,527 B2 8/2006 Rapaport et al.
7,168,951 B2 1/2007 Fischer et al.
7,204,903 B2 4/2007 Yasui
7,228,777 B2 6/2007 Morissette et al.
7,252,028 B2 8/2007 Bechtold et al.
7,262,353 B2 8/2007 Bartholomew et al.
7,275,471 B2 10/2007 Nishri et al.
7,293,371 B2 11/2007 Aveni
7,300,014 B2 11/2007 Allen
7,347,011 B2 3/2008 Dua et al.
D578,294 S 10/2008 Mervar et al.

(56) References Cited

U.S. PATENT DOCUMENTS 7,430,818 B2 10/2008 Valat et al.
7,444,916 B2 11/2008 Hirukawa
7,549,185 B2 6/2009 Yang
7,566,376 B2 7/2009 Matsuoka
7,703,218 B2 4/2010 Burgess
7,793,434 B2 9/2010 Sokolowski et al.
7,793,576 B2 9/2010 Head et al.
7,815,141 B2 10/2010 Uozumi et al.
7,836,608 B2 11/2010 Greene
7,870,681 B2 1/2011 Meschter
7,908,956 B2 3/2011 Dow et al.
7,913,426 B2 3/2011 Valat et al.
7,938,853 B2 5/2011 Chouinard et al.
7,941,942 B2 5/2011 Hooper et al.
7,963,747 B2 6/2011 Cairo
8,006,601 B2 8/2011 Inazawa et al.
8,051,585 B2 11/2011 Hope et al.
8,056,173 B2 11/2011 RongBo
8,061,253 B2 11/2011 Wybrow
8,210,086 B2 7/2012 Head et al.
8,261,648 B1 9/2012 Marchand et al.
8,266,827 B2 9/2012 Dojan et al.
8,312,645 B2 11/2012 Dojan et al.
8,312,646 B2 11/2012 Meschter et al.
8,388,791 B2 3/2013 Dojan et al.
8,394,222 B2 3/2013 Rettig
8,438,757 B2 5/2013 Roser
8,511,214 B2 8/2013 Gries
8,544,197 B2 10/2013 Spanks et al.
8,544,199 B1 10/2013 Pentland
8,578,534 B2 11/2013 Langvin et al.
8,578,632 B2 11/2013 Bell et al.
8,651,007 B2 2/2014 Adams
8,690,962 B2 4/2014 Dignam et al.
8,757,038 B2 6/2014 Siegismund
8,770,081 B2 7/2014 David et al.
8,789,295 B2 7/2014 Burch et al.
8,789,452 B1 7/2014 Janardhan et al.
8,794,118 B2 8/2014 Dow et al.
8,819,963 B2 9/2014 Dojan et al.
8,959,959 B1 2/2015 Podhajny
8,984,776 B2 3/2015 Ludemann et al.
8,997,529 B1 4/2015 Podhajny
D737,561 S 9/2015 Aveni et al.
9,179,739 B2 11/2015 Bell et al.
D769,590 S 10/2016 Aveni et al.
9,681,708 B2 6/2017 Greene et al.
9,756,901 B2 9/2017 Musho et al.
D798,565 S 10/2017 Aveni et al.
10,159,297 B2 12/2018 Jamison
10,238,176 B2 * 3/2019 Bruce ..... A43B 23/042
10,280,538 B2 * 5/2019 Bruce ..... A43B 23/042
2001/0007180 A1 7/2001 Bordin et al.
2003/0000111 A1 1/2003 Basso
2003/0213547 A1 11/2003 Ono et al.
2004/0118018 A1 6/2004 Dua
2004/0244412 A1 12/2004 Trinh et al.
2005/0076536 A1 4/2005 Hatfield et al.
2005/0081402 A1 4/2005 Orei et al.
2005/0115284 A1 6/2005 Dua
2005/0178026 A1 8/2005 Friton
2005/0193592 A1 9/2005 Dua et al.
2005/0208860 A1 9/2005 Baron et al.
2005/0284002 A1 12/2005 Aveni
2006/0048413 A1 3/2006 Sokolowski et al.
2006/0059715 A1 3/2006 Aveni
2006/0162190 A1 7/2006 Nishiwaki et al.
2006/0260365 A1 11/2006 Miyamoto
2006/0265908 A1 11/2006 Palmer et al.
2006/0283042 A1 12/2006 Greene et al.
2006/0283048 A1 12/2006 Lebo
2007/0022627 A1 2/2007 Sokolowski et al.
2007/0062067 A1 3/2007 Covatch
2007/0101615 A1 5/2007 Munns
2007/0101616 A1 5/2007 Munns
2007/0180730 A1 8/2007 Greene et al.
2007/0245595 A1 10/2007 Chen et al.
2007/0271821 A1 11/2007 Meschter
2007/0271822 A1 11/2007 Meschter
2008/0005930 A1 1/2008 Skirrow
2008/0022553 A1 1/2008 McDonald et al.
2008/0078103 A1 4/2008 Liles
2008/0110048 A1 5/2008 Dua et al.
2008/0250668 A1 10/2008 Marvin et al.
2009/0126225 A1 5/2009 Jarvis
2009/0126823 A1 5/2009 Yengkhom
2009/0193961 A1 8/2009 Jensen et al.
2009/0241374 A1 10/2009 Sato et al.
2009/0306762 A1 12/2009 McCullagh et al.
2010/0018075 A1 1/2010 Meschter et al.
2010/0043253 A1 2/2010 Dojan et al.
2010/0095556 A1 4/2010 Jarvis
2010/0095557 A1 4/2010 Jarvis
2010/0107442 A1 5/2010 Hope et al.
2010/0139057 A1 6/2010 Soderberg et al.
2010/0154256 A1 6/2010 Dua
2010/0175276 A1 7/2010 Dojan et al.
2010/0199520 A1 8/2010 Dua et al.
2010/0251491 A1 10/2010 Dojan et al.
2010/0251564 A1 10/2010 Meschter
2010/0319215 A1 12/2010 Roser
2011/0041359 A1 2/2011 Dojan et al.
2011/0067271 A1 3/2011 Foxen et al.
2011/0078921 A1 4/2011 Greene et al.
2011/0088285 A1 4/2011 Dojan et al.
2011/0094127 A1 4/2011 Dana, III
2011/0146104 A1 6/2011 Lafortune
2011/0239486 A1 10/2011 Berger et al.
2011/0266384 A1 11/2011 Goodman et al.
2012/0023786 A1 2/2012 Dojan
2012/0030965 A1 2/2012 Greene et al.
2012/0055044 A1 3/2012 Dojan et al.
2012/0066931 A1 3/2012 Dojan et al.
2012/0096742 A1 4/2012 Shim
2012/0100778 A1 4/2012 Cho
2012/0117826 A1 5/2012 Jarvis
2012/0144698 A1 6/2012 McDowell
2012/0159813 A1 6/2012 Dua et al.
2012/0180195 A1 7/2012 Shull et al.
2012/0186102 A1 7/2012 Lee et al.
2012/0198730 A1 8/2012 Burch et al.
2012/0233882 A1 9/2012 Huffa et al.
2012/0234052 A1 9/2012 Huffa et al.
2012/0240429 A1 9/2012 Sokolowski et al.
2012/0246973 A1 10/2012 Dua
2012/0255201 A1 10/2012 Little
2012/0279260 A1 11/2012 Dua et al.
2012/0291314 A1 11/2012 Sokolowski et al.
2012/0297643 A1 11/2012 Shaffer et al.
2013/0019500 A1 1/2013 Greene
2013/0025157 A1 1/2013 Wan et al.
2013/0055590 A1 3/2013 Mokos
2013/0081307 A1 4/2013 del Biondi et al.
2013/0125420 A1 5/2013 Raghuprasad
2013/0174446 A1 7/2013 Antonelli et al.
2013/0211492 A1 8/2013 Schneider
2013/0219636 A1 8/2013 Dojan et al.
2013/0239438 A1 9/2013 Dua et al.
2013/0255103 A1 10/2013 Dua et al.
2013/0260104 A1 10/2013 Dua et al.
2013/0260629 A1 10/2013 Dua et al.
2013/0269159 A1 10/2013 Robitaille et al.
2013/0269209 A1 10/2013 Lang et al.
2013/0269212 A1 10/2013 Little
2013/0291293 A1 11/2013 Jessiman et al.
2013/0304232 A1 11/2013 Gries
2013/0305465 A1 11/2013 Siegismund
2013/0305911 A1 11/2013 Masson et al.
2013/0312284 A1 11/2013 Berend et al.
2014/0000043 A1 1/2014 Boardman et al.
2014/0007458 A1 1/2014 Berger et al.
2014/0068838 A1 3/2014 Beers et al.
2014/0070042 A1 3/2014 Beers et al.
2014/0082905 A1 3/2014 Wen

(56) References Cited

U.S. PATENT DOCUMENTS

| | | | | |
|---|---|---|---|---|
| 2014/0088688 | A1 | 3/2014 | Lilburn et al. | |
| 2014/0109441 | A1 | 4/2014 | McDowell et al. | |
| 2014/0130372 | A1 | 5/2014 | Aveni et al. | |
| 2014/0134405 | A1 | 5/2014 | Yang | |
| 2014/0137433 | A1 | 5/2014 | Craig | |
| 2014/0137434 | A1 | 5/2014 | Craig | |
| 2014/0150292 | A1 | 6/2014 | Podhajny et al. | |
| 2014/0173932 | A1 | 6/2014 | Bell | |
| 2014/0173934 | A1 | 6/2014 | Bell | |
| 2014/0173935 | A1 | 6/2014 | Sabbioni | |
| 2014/0182447 | A1 | 7/2014 | Kang et al. | |
| 2014/0189964 | A1 | 7/2014 | Wen et al. | |
| 2014/0196316 | A1 | 7/2014 | Follet | |
| 2014/0215850 | A1 | 8/2014 | Redl et al. | |
| 2014/0237854 | A1 | 8/2014 | Fallon | |
| 2014/0245633 | A1 | 9/2014 | Podhajny | |
| 2014/0259760 | A1 | 9/2014 | Dojan et al. | |
| 2014/0310983 | A1 | 10/2014 | Tamm et al. | |
| 2014/0310984 | A1 | 10/2014 | Tamm et al. | |
| 2014/0310987 | A1 | 10/2014 | Sokolowski et al. | |
| 2014/0338222 | A1 | 11/2014 | Song | |
| 2014/0352173 | A1 | 12/2014 | Bell et al. | |
| 2014/0373389 | A1 | 12/2014 | Bruce | |
| 2014/0377488 | A1 | 12/2014 | Jamison | |
| 2015/0007451 | A1 | 1/2015 | Bruce | |
| 2015/0013187 | A1 | 1/2015 | Taniguchi et al. | |
| 2015/0052778 | A1 | 2/2015 | Kirk et al. | |
| 2015/0075031 | A1 | 3/2015 | Podhajny et al. | |
| 2015/0143716 | A1 | 5/2015 | Long et al. | |
| 2015/0143720 | A1 | 5/2015 | Avar | |
| 2015/0201705 | A1 | 7/2015 | Doremus et al. | |
| 2015/0201707 | A1 | 7/2015 | Bruce | |
| 2015/0202915 | A1 | 7/2015 | Lee | |
| 2015/0272274 | A1 | 10/2015 | Berns et al. | |
| 2015/0282564 | A1 | 10/2015 | Meschter et al. | |
| 2015/0282565 | A1 | 10/2015 | Kilgore | |
| 2015/0305442 | A1 | 10/2015 | Ravindran | |
| 2015/0313316 | A1 | 11/2015 | Boucher et al. | |
| 2015/0320139 | A1 | 11/2015 | Peitzker | |
| 2015/0342286 | A1 | 12/2015 | Huffman et al. | |
| 2015/0374064 | A1 | 12/2015 | Pierobon | |
| 2016/0021979 | A1 | 1/2016 | Iuchi et al. | |
| 2016/0029736 | A1 | 2/2016 | Meir | |
| 2016/0058100 | A1 | 3/2016 | Dealey et al. | |
| 2016/0076178 | A1 | 3/2016 | Head et al. | |
| 2016/0095377 | A1 | 4/2016 | Tamm | |
| 2016/0106182 | A1 | 4/2016 | Yun | |
| 2016/0166000 | A1 | 6/2016 | Bruce et al. | |
| 2016/0166007 | A1 | 6/2016 | Bruce et al. | |
| 2016/0166010 | A1 | 6/2016 | Bruce et al. | |
| 2016/0168774 | A1 | 6/2016 | Breithaupt et al. | |
| 2016/0174660 | A1 | 6/2016 | Iuchi et al. | |
| 2016/0185062 | A1 | 6/2016 | Boucher et al. | |
| 2016/0208421 | A1 | 7/2016 | Baines et al. | |
| 2016/0213095 | A1 | 7/2016 | Kohatsu et al. | |
| 2016/0286898 | A1 | 10/2016 | Manz et al. | |
| 2016/0345675 | A1 | 12/2016 | Bruce et al. | |
| 2016/0345676 | A1* | 12/2016 | Bruce | D04C 1/06 |
| 2016/0345677 | A1* | 12/2016 | Bruce | D04C 1/02 |
| 2017/0035149 | A1 | 2/2017 | Bruce et al. | |
| 2017/0325545 | A1 | 11/2017 | Becker et al. | |
| 2017/0325546 | A1 | 11/2017 | Becker et al. | |
| 2018/0213878 | A1 | 8/2018 | Bruce | |
| 2018/0343962 | A1 | 12/2018 | Bruce et al. | |
| 2018/0343963 | A1 | 12/2018 | Bruce et al. | |
| 2018/0368506 | A1 | 12/2018 | Bruce et al. | |
| 2019/0014854 | A1 | 1/2019 | Santos et al. | |
| 2019/0098955 | A1 | 4/2019 | Bruce | |
| 2019/0150552 | A1 | 5/2019 | Casillas et al. | |
| 2019/0231031 | A1* | 8/2019 | Bruce | A43B 23/042 |
| 2019/0254386 | A1 | 8/2019 | Bruce et al. | |
| 2020/0146390 | A1 | 5/2020 | Heidenfelder et al. | |

FOREIGN PATENT DOCUMENTS

| | | | |
|---|---|---|---|
| CN | 1121403 | A | 5/1996 |
| CN | 1883325 | A | 12/2006 |
| CN | 2930360 | Y | 8/2007 |
| CN | 201175007 | Y | 1/2009 |
| CN | 201356120 | Y | 12/2009 |
| CN | 101627843 | A | 1/2010 |
| CN | 101801229 | A | 8/2010 |
| CN | 102271548 | A | 12/2011 |
| CN | 202536202 | U | 11/2012 |
| CN | 202635759 | U | 1/2013 |
| CN | 102987631 | A | 3/2013 |
| CN | 202950101 | U | 5/2013 |
| CN | 203369442 | U | 1/2014 |
| CN | 103653542 | A | 3/2014 |
| CN | 203676256 | U | 7/2014 |
| CN | 20403521 | U | 12/2014 |
| DE | 726634 | C | 10/1942 |
| DE | 1140107 | B | 11/1962 |
| DE | 4306286 | A1 | 9/1993 |
| DE | 19809085 | A1 | 8/1999 |
| DE | 102011011185 | A1 | 8/2012 |
| DE | 102012020216 | A1 | 4/2014 |
| EP | 0372370 | A2 | 6/1990 |
| EP | 1486601 | A1 | 12/2004 |
| EP | 2657384 | A1 | 10/2013 |
| EP | 2792261 | A1 | 10/2014 |
| EP | 2792264 | A2 | 10/2014 |
| EP | 2811056 | A1 | 12/2014 |
| EP | 3011855 | A1 | 4/2016 |
| FR | 1012719 | A | 7/1952 |
| GB | 430805 | A | 6/1935 |
| GB | 477556 | A | 1/1938 |
| GB | 1083849 | A | 9/1967 |
| GB | 1299353 | | 12/1972 |
| JP | S51107964 | U1 | 8/1976 |
| JP | S51107964 UI | | 8/1976 |
| JP | H07054250 | A | 2/1995 |
| JP | 07033076 | B2 | 4/1995 |
| JP | H07216703 | A | 8/1995 |
| JP | 08109553 | A | 4/1996 |
| JP | 09322810 | A | 12/1997 |
| JP | H10158965 | A | 6/1998 |
| JP | 2001030361 | A | 2/2001 |
| JP | 2004339651 | A | 12/2004 |
| JP | 20050422266 | A | 2/2005 |
| JP | 2005102933 | A | 4/2005 |
| JP | 2005290628 | A | 10/2005 |
| JP | 2006009175 | A | 1/2006 |
| JP | 2006161167 | A | 6/2006 |
| JP | 2008240187 | A | 10/2008 |
| KR | 20020038168 | | 5/2002 |
| KR | 100737426 | B1 | 7/2007 |
| WO | 98/24616 | A1 | 6/1998 |
| WO | 0007475 | | 2/2000 |
| WO | 0036943 | A1 | 6/2000 |
| WO | 03016036 | A2 | 2/2003 |
| WO | 2009000371 | A1 | 12/2008 |
| WO | 2010080182 | A1 | 7/2010 |
| WO | 2010/100488 | A1 | 9/2010 |
| WO | 2011082391 | A1 | 7/2011 |
| WO | 2011111564 | A1 | 9/2011 |
| WO | 2011126837 | A2 | 10/2011 |
| WO | 2011137405 | A2 | 11/2011 |
| WO | 2013071679 | A1 | 5/2013 |
| WO | 2013126313 | A2 | 8/2013 |
| WO | 2014134244 | A1 | 9/2014 |
| WO | 2014209594 | A1 | 12/2014 |
| WO | 2014209596 | A1 | 12/2014 |
| WO | 2016093961 | A1 | 6/2016 |
| WO | 2016191478 | A1 | 12/2016 |

OTHER PUBLICATIONS

Office Action received for European Patent Application No. 16727106.3, dated Apr. 8, 2020, 6 pages.

(56) References Cited

OTHER PUBLICATIONS

Communication under Rule 71(3) dated Feb. 20, 2019 in European Patent Application No. 15785032.2, 5 pages.
Communication under Rule 71(3) dated Mar. 13, 2019 in European Patent Application No. 15787396.9, 5 pages.
International Search Report and Written Opinion received for PCT Patent Application No. PCT/US2019/036495, dated Nov. 8, 2019, 20 pages.
Non-Final Office Action received for U.S. Appl. No. 15/993,195, dated Feb. 6, 2020, 16 pages.
Final Office Action received for U.S. Appl. No. 14/163,438, dated Jan. 13, 2020, 12 pages.
International Preliminary Report on Patentability received for PCT Patent Application No. PCT/US2018/035404, dated Dec. 12, 2019, 8 pages.
Office Action received for European Patent Application No. 15787425.6, dated Jan. 23, 2020, 6 pages.
Summons to Attend Oral Proceedings received for European Patent Application No. 16001887.5, mailed on Dec. 2, 2019, 5 pages.
Final Office Action received for U.S. Appl. No. 14/566,215, dated Jan. 30, 2020, 26 pages.
International Search Report and Written Opinion dated Sep. 10, 2018 in International Patent Application No. PCT/US2018/035404, 13 pages.
Non-Final Office Action dated Sep. 18, 2018 in U.S. Appl. No. 15/613,983, 7 pages.
Non-Final Office Action dated Oct. 1, 2018 in U.S. Appl. No. 14/820,822, 15 pages.
Extended Search Report dated Nov. 29, 2019 in European Patent Application No. 19192467.9, 5 pages.
Partial search report dated Dec. 9, 2019 in European Patent Application No. 19191026.4, 15 pages.
International Preliminary Report on Patentability dated Dec. 12, 2019 in International Patent Application No. PCT/US2018/035417, 8 pages.
International Preliminary Report on Patentability dated Dec. 12, 2019 in International Patent Application No. PCT/US2018/035408, 10 pages.
Final Office Action dated Jun. 4, 2018 in U.S. Appl. No. 14/820,822, 14 pages.
Final Office Action dated Jun. 26, 2018 in U.S. Appl. No. 14/566,215, 17 pages.
Final Office Action dated Jul. 13, 2018 in U.S. Appl. No. 14/163,438, 15 pages.
Extended European Search Report received for European Patent Application No. 19191026.4, dated Mar. 12, 2020, 12 pages.
Notice of Allowance received for U.S. Appl. No. 14/565,598, dated Mar. 16, 2020, 8 pages.
Final Office Action dated Aug. 27, 2018 in U.S. Appl. No. 14/721,450, 9 pages.
Final Office Action dated Sep. 11, 2018 in U.S. Appl. No. 14/495,252, 14 pages.
Non-Final Office Action dated Oct. 29, 2019 in U.S. Appl. No. 14/820,822, 15 pages.
Non-Final Office Action dated Nov. 1, 2019 in U.S. Appl. No. 14/565,598, 18 pages.
Branscomb et al., "New Directions in Braiding", Journal of Engineered Fibers and Fabrics, vol. 8, Issue Feb. 2013 Braiding, Journal of Engineered Fibers and Fabrics, vol. 8, Issue Feb. 2013—http://www.jeffournal.org, pp. 11-24.
Non-Final Office Action dated Mar. 29, 2018 in U.S. Appl. No. 14/495,252, 14 pages.
Non-Final Office Action dated May 10, 2018 in U.S. Appl. No. 14/565,598, 17 pages.
Office Action dated Mar. 7, 2018 in U.S. Appl. No. 14/721,450, 7 pages.
Office Action dated Mar. 8, 2018 in Taiwan Patent Application No. 10720204590, 6 pages.
Office Action dated Mar. 8, 2018 in Taiwan Patent Application No. 10720204610, 6 pages.
U.S. Appl. No. 14/721,614, filed May 26, 2015.
U.S. Appl. No. 14/721,563, filed May 26, 2015.
International Search Report and Written Opinion dated Apr. 15, 2019 in International Patent Application No. PCT/US2018/061502, 18 pages.
Extended Search Report dated Aug. 16, 2019 in European Patent Application No. 18202740.9, 11 pages.
Non-Final Office Action dated Aug. 19, 2019 in U.S. Appl. No. 14/163,438, 15 pages.
Non-Final Office Action dated Aug. 21, 2009 in U.S. Appl. No. 14/566,215, 21 pages.
Notice of Allowance dated Sep. 16, 2019 in U.S. Appl. No. 14/721,450, 9 pages.
Final Office Action dated Apr. 25, 2019 in U.S. Appl. No. 14/820,822, 15 pages.
Partial search report dated Apr. 26, 2019 in European Patent Application No. 18202740.9, 13 pages.
Final Office Action dated May 1, 2019 in U.S. Appl. No. 14/721,450, 6 pages.
Communication pursuant to Article 94(3) dated May 13, 2019 in European Patent Application No. 16001887.5, 4 pages.
Communication under Rule 71(3) dated May 16, 2019 in European Patent Application No. 16731401.2, 5 pages.
Communication under Rule 71(3) dated Jun. 21, 2019 in European Patent Application No. 15785032.2, 2 pages.
Non-Final Office Action dated Jul. 9, 2019 in U.S. Appl. No. 14/721,450, 6 pages.
Non-Final Office Action received for U.S. Appl. No. 15/993,190, dated May 7, 2020, 11 pages.
Non-Final Office Action received for U.S. Appl. No. 15/940,234, dated May 29, 2020, 12 pages.
International Preliminary Report on Patentability received for PCT Patent Application No. PCT/US2018/061502, dated Jun. 4, 2020, 10 pages.
Office Action received for Canadian Patent Application No. 3020031, dated Jun. 5, 2020, 5 pages.
Office Action received for Indian Patent Application No. 201747019912, dated Jun. 16, 2020, 5 pages.
Office Action received for Indian Patent Application No. 201747019980, dated Jun. 16, 2020, 5 pages.
Final Office Action received for U.S. Appl. No. 14/820,822, dated Jun. 9, 2020, 18 pages.
Final Office Action received for U.S. Appl. No. 15/993,180, dated Jun. 12, 2020, 15 pages.
Non-Final Office Action received for U.S. Appl. No. 16/192,129, dated Jun. 12, 2020, 10 pages.
Notice of Allowance received for U.S. Appl. No. 15/993,195, dated Jun. 5, 2020, 5 pages.
Decision to grant a European patent pursuant to Article 97(1) dated Nov. 8, 2018 in European Patent Application No. 14737100.9, 1 page.
Communication pursuant to Article 94(3) dated Nov. 22, 2018 in European Patent Application No. 167314012, 5 pages.
Communication pursuant to Article 94(3) dated Nov. 23, 2018 in European Patent Application No. 15787425.6, 7 pages.
Final Office Action dated Dec. 14, 2018 in U.S. Appl. No. 14/565,598, 22 pages.
Non-Final Office Action dated Dec. 28, 2018 in U.S. Appl. No. 14/721,450, 6 pages.
Notice of Allowance dated Jan. 11, 2019 in U.S. Appl. No. 15/613,983, 7 pages.

* cited by examiner

HYBRID BRAIDED ARTICLE

CROSS-REFERENCE TO RELATED APPLICATIONS

This application is a Divisional U.S. Patent Application of U.S. Non-Provisional patent application Ser. No. 14/721,507, entitled "Hybrid Braided Article," filed May 26, 2015, which is hereby incorporated by reference in its entirety.

BACKGROUND OF THE INVENTION

The present embodiments relate generally to articles of footwear, and in particular to articles of footwear with uppers.

Articles of footwear generally include an upper and one or more sole structures. The upper may be formed from a variety of materials that are stitched or adhesively bonded together to form a void within the footwear for comfortably and securely receiving a foot. The sole structures may include midsole structures that provide cushioning and shock absorption.

BRIEF SUMMARY OF THE INVENTION

In one aspect, the invention provides a sole and an upper attached to the sole. The upper includes a first portion and a second portion. The first portion has a Jacquard braid pattern. The second portion has a Non-Jacquard braid pattern.

In another aspect, the invention provides a sole and an upper attached to the sole. The upper includes a seamless braided structure. The seamless braided structure includes a top portion and a lower portion. The top portion has a Jacquard braid pattern. The lower portion has a Non-Jacquard braid pattern.

In another aspect, the invention provides a method of making an article of footwear. The method comprises providing a set of spools to configure with a set of tensile elements. Providing a braiding machine configured with the set of spools. Passing a last through a braiding point, where the tensile elements converge thereby forming a seamless braided structure on the last. Moving the set of spools through a first section to form a first braid portion of the braided structure. Moving the set of spools through a second section to form a second braid portion of the braided structure. Wherein a set of rotor gears move the set of spools in a Jacquard motion in the first section. Wherein the set of rotor gears move the set of spools in a Non-Jacquard motion in the second section.

Other systems, methods, features, and advantages of the invention will be, or will become, apparent to one of ordinary skill in the art upon examination of the following figures and detailed description. It is intended that all such additional systems, methods, features, and advantages be included within this description and this summary, be within the scope of the invention, and be protected by the following claims.

BRIEF DESCRIPTION OF THE SEVERAL VIEWS OF THE DRAWING

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE INVENTION

Figure 1:
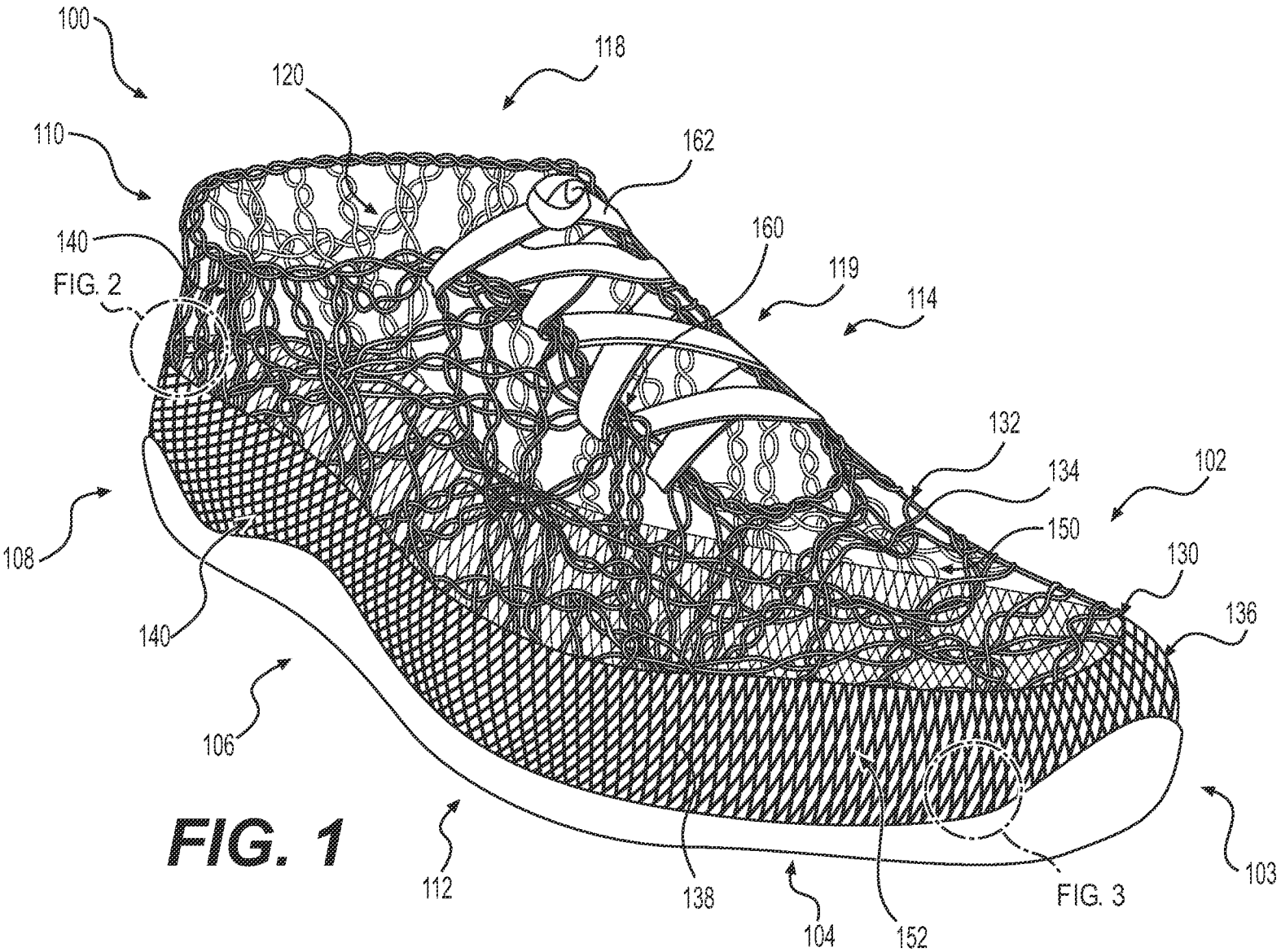
FIG. 1 is an isometric view of an embodiment of an article of footwear with a first braided portion and a second braided portion.

FIG. 1 illustrates an isometric view of an embodiment of an article of footwear. In some embodiments, article of footwear 100, also referred to simply as article 100, is in the form of an athletic shoe. In some other embodiments, the provisions discussed herein for article 100 could be incorporated into various other kinds of footwear including, but not limited to, basketball shoes, hiking boots, soccer shoes, football shoes, sneakers, running shoes, cross-training shoes, rugby shoes, baseball shoes as well as other kinds of shoes. Moreover, in some embodiments, the provisions discussed herein for article of footwear 100 could be incorporated into various other kinds of non-sports related footwear, including, but not limited to, slippers, sandals, high-heeled footwear, loafers, as well as other kinds of footwear.

In some embodiments, article 100 may be characterized by various directional adjectives and reference portions. These directions and reference portions may facilitate in describing the portions of an article of footwear. Moreover, these directions and reference portions may also be used in describing subcomponents of an article of footwear, for example, directions and/or portions of a midsole structure, an outer sole structure, an upper, or any other components.

For consistency and convenience, directional adjectives are employed throughout this detailed description corresponding to the illustrated embodiments. The term "longitudinal" as used throughout this detailed description and in the claims may refer to a direction extending the length of article 100. In some cases, the longitudinal direction may extend from a forefoot region to a heel region of article 100. Also, the term "lateral" as used throughout this detailed description and in the claims may refer to a direction extending along the width of article 100. In other words, the lateral direction may extend between a lateral side and a medial side of article 100. Furthermore, the term "vertical" as used throughout this detailed description and in the claims may refer to a direction generally perpendicular to a lateral and longitudinal direction. For example, in some cases where article 100 is planted flat on a ground surface, the vertical direction may extend from the ground surface upward. In addition, the term "proximal" may refer to a portion of article 100 that is closer to portions of a foot, for example, when article 100 is worn. Similarly, the term "distal" may refer to a portion of article 100 that is further from a portion of a foot when article 100 is worn. It will be understood that each of these directional adjectives may be used in describing individual components of article 100, such as an upper, outsole member, midsole member, as well as other components of an article of footwear.

As shown in FIG. 1, article 100 may be associated with the right foot; however, it should be understood that the following discussion may equally apply to a mirror image of article 100 that is intended for use with a left foot. In some embodiments, an article may include upper 102. Likewise, article 100 may include sole structure 103 secured to upper 102. For purposes of reference, article 100 may be divided into forefoot portion 104, midfoot portion 106, and heel portion 108. Forefoot portion 104 may be generally associated with the toes and joints connecting the metatarsals with the phalanges. Midfoot portion 106 may be generally associated with the arch of a foot. Likewise, heel portion 108 may be generally associated with the heel of a foot, including the calcaneus bone. Article 100 may also include ankle portion 110 (which may also be referred to as a cuff portion). In addition, article 100 may include lateral side 112 and medial side 114. In particular, lateral side 112 and medial side 114 may be opposing sides of article 100. In general, lateral side 112 may be associated with the outside parts of a foot while medial side 114 may be associated with the inside part of a foot. Furthermore, lateral side 112 and medial side 114 may extend through forefoot portion 104, midfoot portion 106, and heel portion 108.

It will be understood that forefoot portion 104, midfoot portion 106, and heel portion 108 are only intended for purposes of description and are not intended to demarcate precise regions of article 100. Likewise, lateral side 112 and medial side 114 are intended to represent generally two sides rather than precisely demarcating article 100 into two halves.

In some embodiments, article 100 may be configured with upper 102. Upper 102 may include ankle opening 118 to provide access to interior cavity 120. Upper 102 may also include throat opening 119 to further facilitate access to interior cavity 120. In some embodiments, upper 102 may incorporate a plurality of material elements (for example, textiles, polymer sheets, foam layers, leather, synthetic leather) that are stitched or bonded together to form an interior void for securely and comfortably receiving a foot. In some cases, the material elements may be selected to impart properties of durability, air permeability, wear resistance, flexibility, and comfort, for example, to specific areas of upper 102.

Some embodiments may include provisions for providing different physical characteristics and properties for an upper. In some embodiments, article 100 may have upper 102 formed with braided structure 130. In some embodiments, upper 102 may have more than one braided structure. In an exemplary embodiment, upper 102 may have top part or first portion 132 formed with first braided structure 134, and lower part or second portion 136 formed with second braided structure 138. In some embodiments, first braided structure 134 may have different characteristics than second braided structure 138 even though both structures are formed from the same tensile elements.

In some embodiments, first portion 132 with first braided structure 134 may extend along the length of article 100 along a longitudinal direction from forefoot portion 104 through midfoot portion 106 to heel portion 108. In some cases, first portion 132 may also include ankle opening 118 and throat opening 119.

Likewise, in some embodiments, second portion 136 with second braided structure 138 may extend along the length of article 100 along a longitudinal direction from forefoot portion 104 through midfoot portion 106 to heel portion 108. Second portion 136 may also extend along the width of the article along a lateral direction from lateral side 112 to medial side 114. Further, second portion 136 may be in direct contact with sole structure 103.

Figure 2:
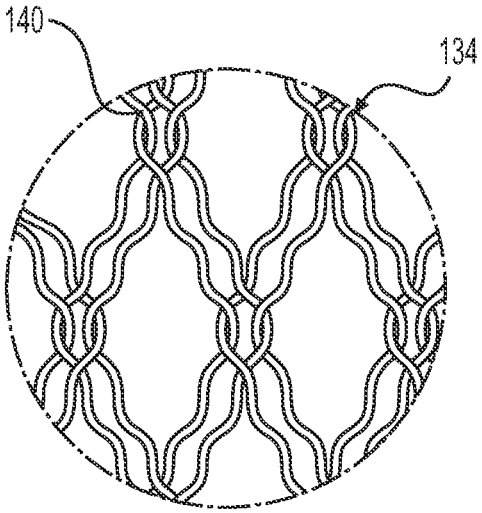
FIG. 2 is a schematic close-up view of a first braided portion of FIG. 1.
Figure 3:
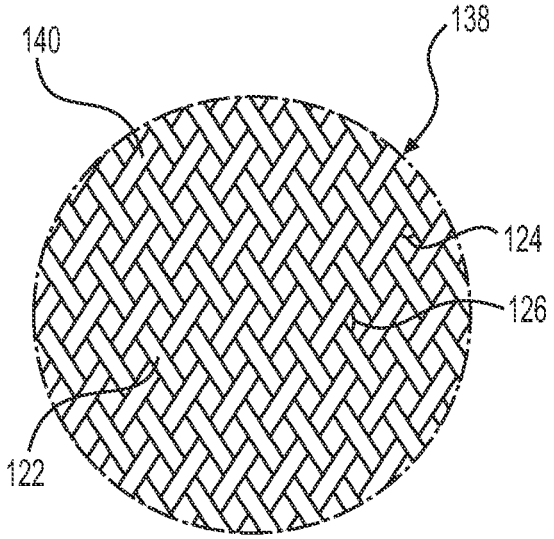
FIG. 3 is a schematic close-up view of a second braided portion of FIG. 1.

As shown FIGS. 2 and 3, first braided structure 134 may have components that are arranged in a braid pattern that is different from second braided structure 138. In some embodiments, the components or tensile elements may be arranged in a braid pattern where tensile elements are more or less dense. In one embodiment, tensile elements 140 for second braided structure 138 are braided to have a greater density than tensile elements 140 braided for first braided structure 134. Furthermore, as arranged, tensile elements 140 in second braided structure 138 substantially form a rhombiform mesh pattern 122 having two acute angles 124 and two obtuse angles 126. In some other embodiments, tensile elements 140 in second braided structure 138 may form a mesh pattern where the angles are substantially the same. In some embodiments, the different types of braided structures may impart different physical properties for an upper. The different properties associated with different braided structures will be explained further in detail below.

The detailed description and the claims may make reference to various kinds of tensile elements, braided structures, braided configurations, braided patterns, and braiding machines. As used herein, the term "tensile element" refers to any kinds of threads, yarns, strings, filaments, fibers, wires, cables as well as possibly other kinds of tensile elements described below or known in the art. As used herein, tensile elements may describe generally elongated materials with lengths much greater than corresponding diameters. In some embodiments, tensile elements may be approximately one-dimensional elements. In some other embodiments, tensile elements may be approximately two dimensional, that is, with thicknesses much less than their lengths and widths. Tensile elements may be joined to form braided structures. A "braided structure" may be any structure formed intertwining three or more tensile elements together. Braided structures could take the form of braided cords, ropes, or strands. Alternatively, braided structures may be configured as two-dimensional structures, for example, flat braids, or three-dimensional structures, for example, braided tubes, such as with lengths and widths (or diameters) significantly greater than their thicknesses.

A braided structure may be formed in a variety of different configurations. Examples of braided configurations include, but are not limited to, the braiding density of the braided structure, the braid tension(s), the geometry of the structure, for example, formed as a tube, or an article; the properties of individual tensile elements, for example, materials, cross-sectional geometry, elasticity, tensile strength; as well as other features of the braided structure. One specific feature of a braided configuration may be the braid geometry, or braid pattern, formed throughout the entirety of the braided configuration or within one or more regions of the braided structure. As used herein, the term "braid pattern" refers to the local arrangement of tensile elements in a region of the braided structure. Braid patterns can vary widely and may differ in one or more of the following characteristics: the orientations of one or more groups of tensile elements (or strands), the geometry of spaces or openings formed between braided tensile elements, the crossing patterns between various strands as well as possibly other characteristics. Some braided patterns include lace-braided or Jacquard patterns, such as Chantilly, Bucks Point, and Torchon. Other patterns include biaxial diamond braids, biaxial regular braids, as well as various kinds of triaxial braids.

Braided articles or braided structures can be formed with various kinds of braid patterns, as described above. The present embodiments may be characterized as having braid patterns than are "jacquard braid patterns" or "non-jacquard braid patterns". Jacquard braid patterns and non-jacquard braid patterns may refer to distinct classes of braid patterns. Thus jacquard braid patterns may comprise a variety of different braid patterns that share common features, and non-jacquard braid patterns may comprise a variety of different braid patterns that share common features. One type of jacquard braid pattern may be a lace braid pattern. Another type of jacquard braid pattern may be a Torchon braid pattern, or Torchon lace braid pattern. In contrast, non-jacquard braid patterns may be associated with bi-axial, tri-axial, diamond, or other kinds of regular braid patterns. In some cases, a non-jacquard braid pattern may be referred to as a radial braid pattern, as non-jacquard braid patterns can be easily formed using a radial braiding machine. However, it may be appreciated that in some cases non-jacquard braid patterns can also be formed from machines that may not be radial braiding machines. Thus, it should be appreciated that the terms "jacquard braid pattern" and "non-jacquard braid pattern" refer to the configuration of a braided structure, and may be independent of the type of machine, or method, used to make the braided structure.

Generally, jacquard braid patterns and non-jacquard braid patterns may have different characteristics. For example, jacquard braid patterns may be characterized as more open, with spacing between adjacent tensile strands varying in a non-uniform manner. In contrast, non-jacquard braid patterns may generally be uniform. In some cases, non-jacquard braid patterns may be grid or lattice like. Jacquard and non-jacquard braid patterns can also be characterized by the presence or absence of ornamental designs. Specifically, jacquard braid patterns may feature one or more ornamental designs whereas non-jacquard braid patterns lack such ornamental designs due to the nature in which they are formed (by moving spools around on a constant path of the braiding machine). Further, the density of tensile strands (e.g., the average number of strands in a given area) may be highly variable in a jacquard braid pattern and may change along multiple directions of the braided structure. In contrast, the density of tensile strands in a non-jacquard braid pattern may generally be constant, or change only along a single axial direction dictated by the method of forming a braided structure. Thus, while some non-jacquard braid patterns could have densities that vary along one axis of the structure, they may generally not vary in density along multiple different directions of the structure.

In some embodiments, different braid patterns may be selected for different portions of an upper. For example, as seen in FIG. 1, first portion 132 has braided tensile elements 140 arranged in a first pattern that is different in appearance than a second pattern shown in second portion 136.

Figure 4:
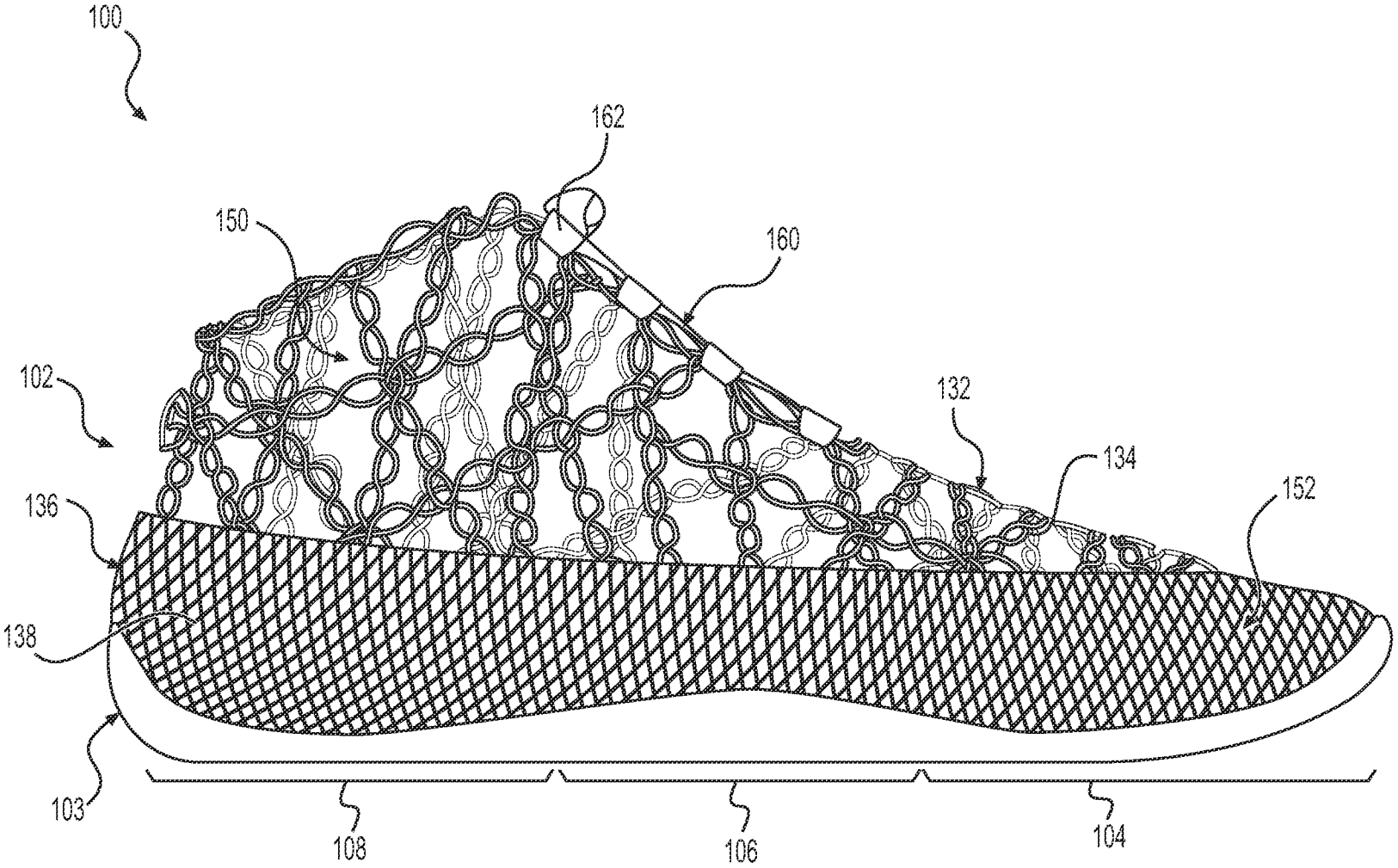
FIG. 4 is a side view of an embodiment of an article of footwear with an upper having a first braided portion and a second braided portion.

Referring to FIG. 4, a side view of article 100 having an upper 102 attached to sole structure 103 is shown. In some embodiments, upper 102 includes a top part with first portion 132 having first braided structure 134, and a lower part with second portion 136 having second braided structure 138 is shown.

In some embodiments, first braided structure 134 may have first braid pattern 150 and second braid pattern 152 (shown also in FIG. 1). First braid pattern 150 may be may be associated with a Jacquard braid pattern. Second braid pattern 152 may be associated with a Non-Jacquard braid pattern. With this arrangement, article 100 may have physical properties that vary with different portions of upper 102. For example, in some embodiments, a braided structure with a Jacquard braid pattern may have a lower density or greater elasticity than a braided structure with a Non-Jacquard braid pattern. In still some cases, a braided structure with a Jacquard braid pattern may further include intricate patterns and designs that may be absent from a braided structure with a Non-Jacquard braid pattern. In some other cases, a braided structure with a Non-Jacquard braid patterns may have a greater density and greater abrasion resistance than a braided structure with a Jacquard braid pattern.

In some embodiments, first braid pattern 150 may include finished edge 160. As used in this detailed description and in the claims, finished edge 160 and its variants thereof may refer to an aperture or opening that may eliminate a need for cutting, sewing, or skinning to create a structure for eyelets, laces, or other components facilitating the adjustment of article 100 to a user's foot. As shown in FIG. 1, in some embodiments, first braid pattern 150 with finished edge 160 eliminates the need for eyelets for laces 162. Alternatively, first braid pattern 150 could be formed with explicitly defined eyelet regions adjacent finished edge 160. Moreover, this feature allows further reduction of the overall weight of article 100 while still enabling the adjustment of article 100 on a user's foot.

Figure 6:
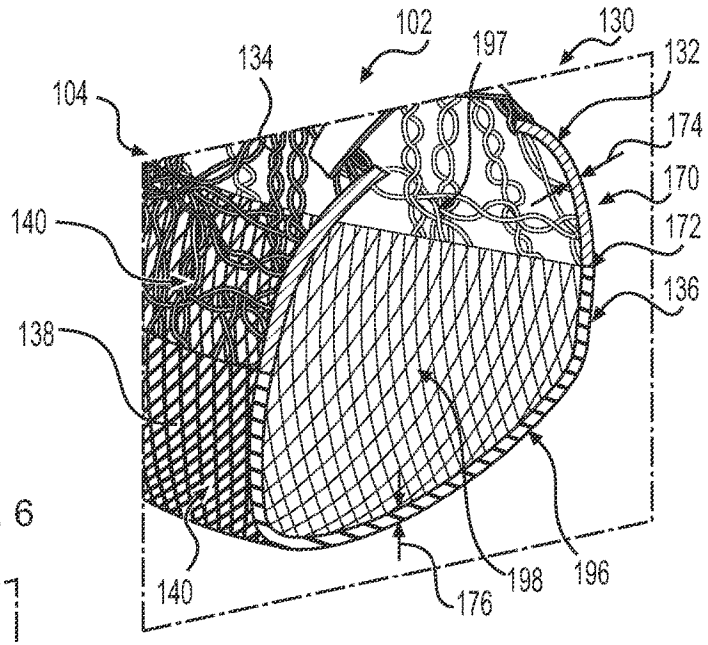
FIG. 6 is a schematic enlarged isometric view of a forefoot portion of the article of footwear of FIG. 5.
Figure 5:
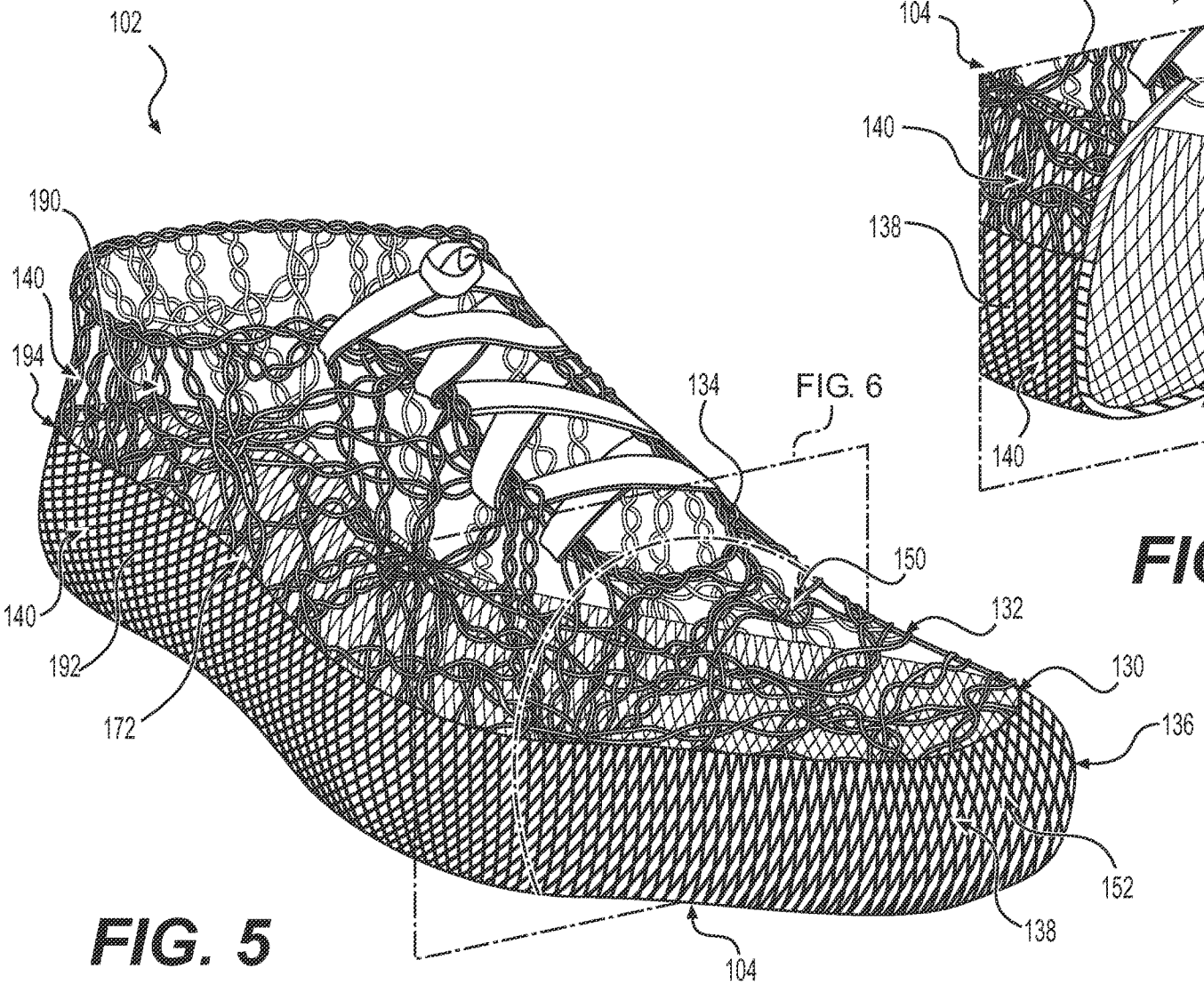
FIG. 5 is an isometric view of an embodiment of an article of footwear with an upper having a first braided portion and a second braided portion.

FIGS. 5 and 6 illustrate an isometric view of upper 102 with braided structure 130 comprising first portion 132 and second portion 136, including an enlarged isometric view of a portion of braided structure 130. In particular, an isometric cross-sectional view of forefoot portion 104 of braided structure 130 is shown. For purposes of illustration, upper 102 and braided structure 130 are shown isolated from sole structure 103.

As seen in FIG. 6, forefoot portion 104 has cross-sectional area 170 where first braided structure 134 is incorporated with second braided structure 138 to form seamless braided structure 172. It is to be noted that the same tensile elements 140 are used in first braided structure 134, which has a first braid pattern, and second braided structure 138, which has a second braid pattern.

Referring to FIGS. 5 and 6, in some embodiments, first surface area 190 of first braided structure 134 may encompass 50 percent or more of total surface area 194 of seamless braided structure 172. In some embodiments, second surface area 192 of second braided structure 138 may encompass 50 percent or more of total surface area 194 of seamless braided structure 172. In one embodiment, seamless braided structure 172 may have half of its total surface area 194 with a Jacquard braid pattern, and the other half with a Non-Jacquard braid pattern.

In some cases, total cross-sectional area 196 of upper 102 with seamless braided structure 172 may also be divided between Jacquard and Non-Jacquard braid patterns. In one embodiment, total cross-sectional area 196 may be divided equally between first cross-sectional area 197 with a Jacquard braid pattern and second cross-sectional area 198 with a Non-Jacquard braid pattern.

Some embodiments may provide different zones or portions of an upper with varying degrees of different physical properties. In some embodiments, a degree of relative thickness between a first portion and a second portion may vary. In some other embodiments, a degree of relative tensile strength may vary between a first portion and a second portion. In still some other embodiments, a degree of relative flexibility may vary between a first portion and a second portion. In different embodiments, a degree of relative abrasion resistance may vary between a first portion and a second portion. In other embodiments, other physical properties within the upper may vary between different portions.

In some embodiments, an upper may have a degree of relative thickness between different braided structures. In some embodiments, the thickness of first portion 132 with first braided structure 134 may be substantially the same as the thickness of second portion 136 with second braided structure 138. In an exemplary embodiment, first braided structure 134 with first braid pattern 150 (i.e., Jacquard braid pattern) may have first thickness 174 that is substantially the same as second thickness 176 of second braided structure 138 with second braid pattern 152 (i.e., Non-Jacquard braid pattern). In some other embodiments, the thicknesses may be substantially different. With this capability, the thickness of a braided structure for a portion of an upper may be tuned to provide a desired customized fit or comfort to the wearer.

In some embodiments, a degree of relative tensile strength between first braided structure 134 and second braided structure 138 may vary. In some embodiments, first portion 132 with first braided structure 134 may exhibit a higher tensile strength than second portion 136. Therefore, first braided structure 134 may provide greater stretch resistance in locations where desired. In some other embodiments, those skilled in the art may provide second braided structure 138 with a higher tensile strength than first braided structure 134.

In some embodiments, a degree of relative flexibility between first braided structure 134 and second braided structure 138 may vary. In some embodiments, first portion 132 with first braided structure 134 may be more flexible because of first braid pattern 150. In some embodiments, tensile elements 140 arranged in first braid pattern 150 (i.e., a Jacquard braid pattern) provides greater flexibility than tensile elements arranged in second braid pattern 152 (i.e., a Non-Jacquard braid pattern). In some other embodiments, upper 102 may have different portions with greater degrees of flexibility.

In some embodiments, a degree of relative wear or abrasion resistance between first braided structure 134 and second braided structure 138 may vary. In one embodiment, second portion 136 with second braided structure 138 may be more wear resistant because of second braid pattern 152. In certain embodiments, the relative density of tensile elements 140 arranged in a Non-Jacquard braid pattern may exhibit greater abrasion resistance than other portions with other braided structures and braid patterns. Therefore, portions of upper 102 proximal to a ground surface may be formed to be sufficiently durable and complement the wear resistance of a sole structure attached to upper 102.

Some braided portions may encompass a greater area of an upper than other braided portions. In some embodiments, an upper may have a first braided structure with a Jacquard braid pattern covering more of an upper's surface area than a second braided structure with a Non-Jacquard braid pattern. FIGS. 7-10 illustrate several variations of an upper with different braided structures having different braid patterns encompassing more or less of an upper's surface area. For purposes of illustration, the figures show an upper for an article of footwear without a sole structure.

Figure 8:
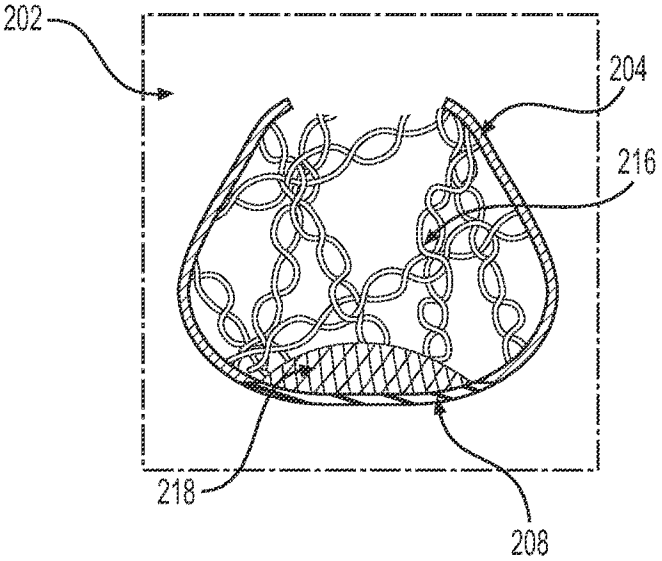
FIG. 8 is a schematic cross-sectional view of a forefoot portion of the article of footwear of FIG. 7.
Figure 7:
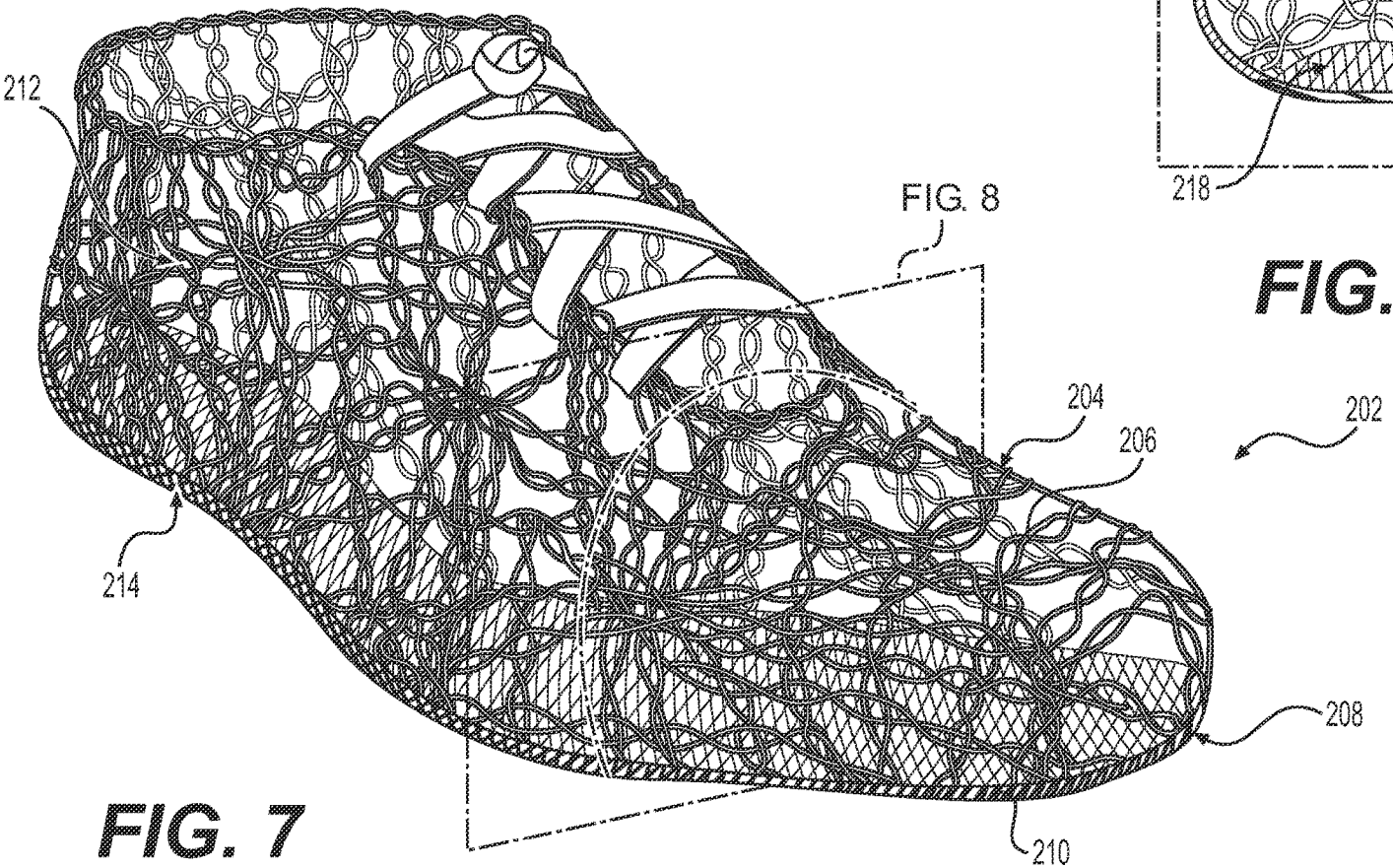
FIG. 7 is a schematic view of an embodiment of an article of footwear with an upper having a first braided portion and a second braided portion.

The exemplary embodiment shown in FIGS. 7 and 8 illustrate the relative surface area of upper 202 covered by first portion 204 with first braided structure 206 and second portion 208 with second braided structure 210. In particular, FIG. 7 shows an isometric view of upper 202 having first braided structure 206 with first braid pattern 212, (i.e., Jacquard braid pattern), encompassing more of a surface area than second braided structure 210 with second braid pattern 214 (i.e., Non-Jacquard braid pattern).

FIG. 8 illustrates an enlarged cross-sectional view of first portion 204 and second portion 208. As shown, second portion 208 covers only the lower part of upper 202. Moreover, as shown in the enlarged cross-sectional view, first cross-sectional area 216 of first portion 204 is greater than second cross-sectional area 218 of second portion 208. In some embodiments, with this arrangement, upper 202, having its surface area covered by a majority of first braided structure 206, may result in upper 202 being lighter thereby reducing the overall weight of an article of footwear. In some cases, with this arrangement, because first portion 204 has a more open structure, first portion 204 is more breathable than second portion 208 and allows moisture to be transmitted through the material more readily.

Figure 10:
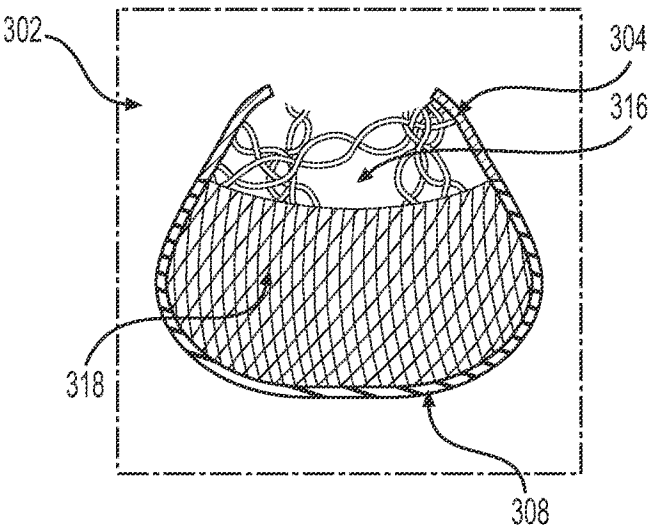
FIG. 10 is a schematic view of an enlarged cross-sectional view of a forefoot portion of the article of footwear of FIG. 9.
Figure 9:
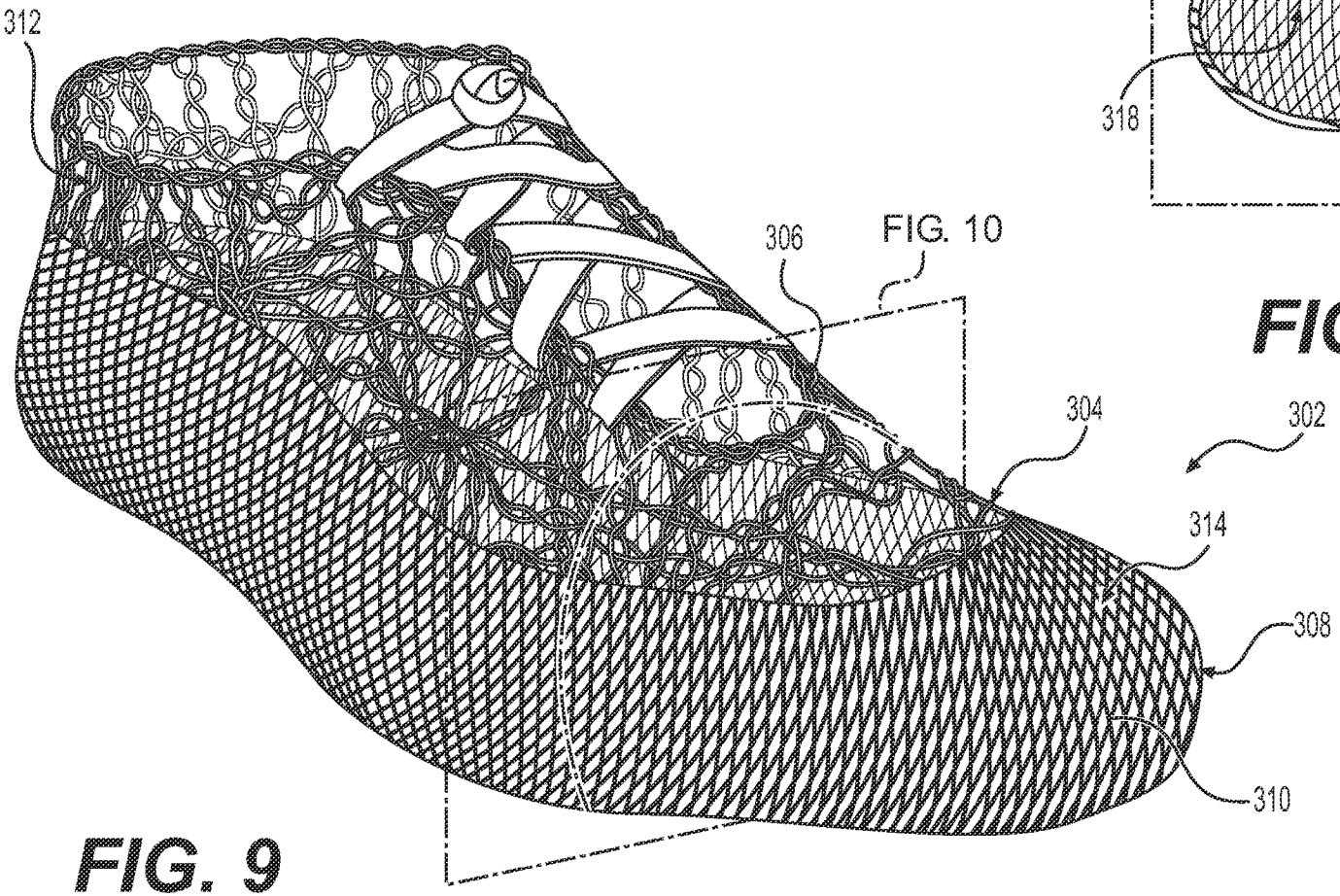
FIG. 9 is a schematic view of an embodiment of an article of footwear with an upper having a first braided portion and a second braided portion.

In contrast to the embodiment shown in FIGS. 7 and 8, in other embodiments, a first braided structure may encompass less of a surface area than a second braided structure. Referring to FIGS. 9 and 10, in one embodiment, second portion 308, having second braided structure 310 with second braid pattern 314 (i.e., Non-Jacquard braid pattern), may cover a greater surface area of upper 302 than first portion 304 having first braided structure 306 with first braid pattern 312 (i.e., Jacquard braid pattern). Further, FIG. 10 illustrates an enlarged view of second cross-sectional area 318 that is greater than first cross-sectional area 316.

In some embodiments, upper 302 with a surface area covered by a majority of second braided structure 310 may vary the physical properties of upper 302. In one embodiment, upper 302, having a majority of its surface area covered by second braided structure 310, may be resistant to abrasion and water than first braided structure 306. In still some other embodiments, second braided structure 310, having axial tensile elements, may improve the overall stability of the article.

Figure 11:
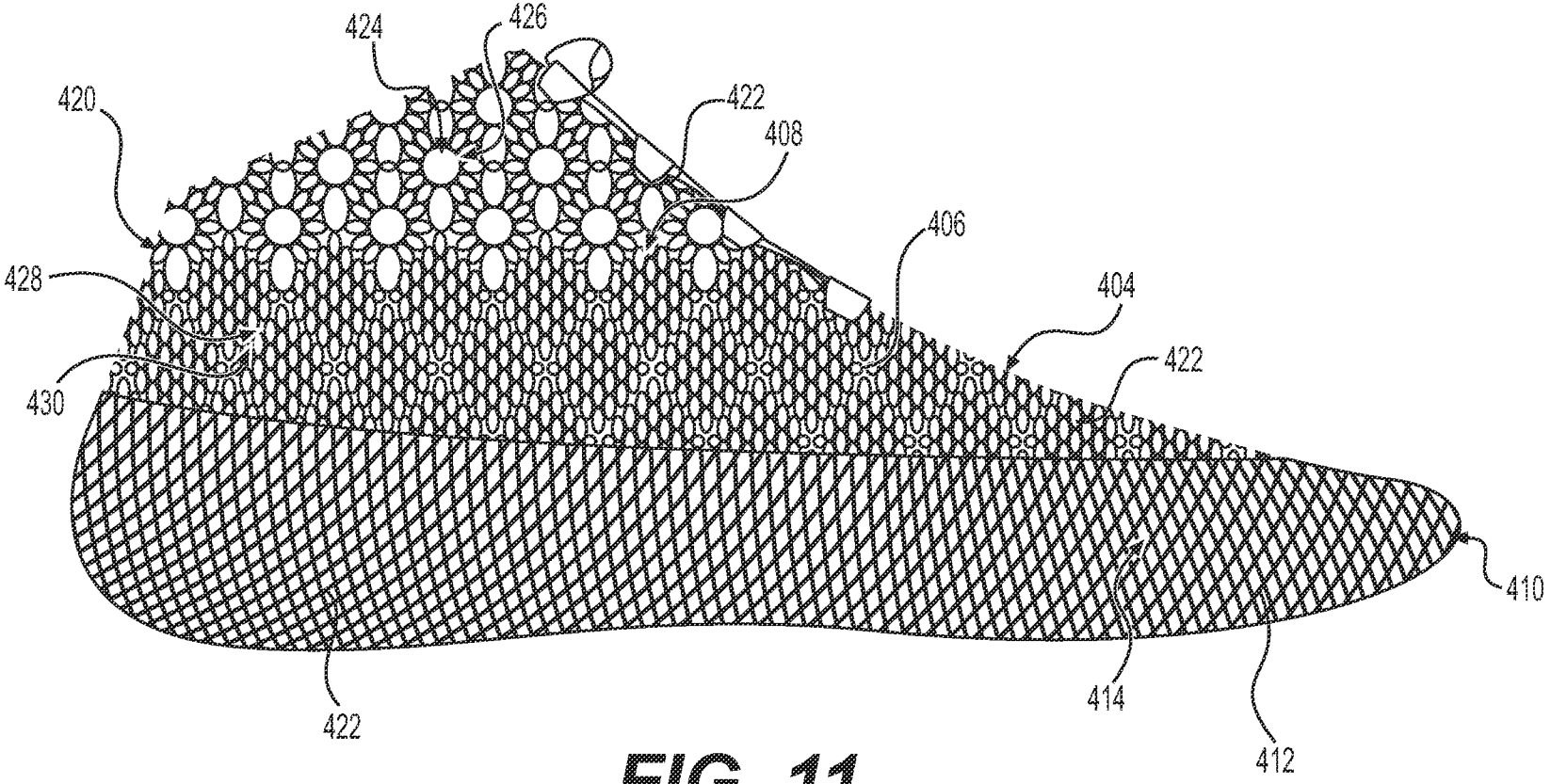
FIG. 11 is a schematic view of an embodiment of an article of footwear with a first braided portion and a second braided portion.

Referring to FIG. 11, another variation of an article with an upper is illustrated. In some embodiments, first portion 404 with first braided structure 406 may comprise of first braid pattern 408. In some embodiments, first braid pattern 408 may be a Jacquard braid pattern. Further, second portion 410 with second braided structure 412 may comprise of second braid pattern 414 or a Non-Jacquard braid pattern. In certain embodiments, first braid pattern 408 may include several intricate or ornamental designs, referred to hereafter as textures 420. Textures 420 may be formed by the intersection of tensile elements 422 during the braiding process. The intersection of tensile elements 422 to form textures 420 may be referred to hereafter as a stitch. In some embodiments, first texture 424 may be formed by first stitch 426. In some cases, first stitch 426 provides first texture 424 with tensile elements 422 spaced apart to resemble netting or a lattice-like structure. In some embodiments, first braid pattern 408 may include a second texture 428 formed by second stitch 430. Second texture 428 may be characterized as having a less open texture than first texture 424 but still associated with a Jacquard braid pattern. Moreover, as already discussed above, the different textures for first portion 404 may impart different physical properties such as flexibility. In some other embodiments, those skilled in the art may use other stitches to form other textures 420 thereby providing other distinct ornamental designs or physical properties to a braided structure with a Jacquard braid pattern.

As used herein, a "braiding machine" is any machine capable of automatically intertwining three or more tensile elements to form a braided structure. Braiding machines may generally include spools, or bobbins, that are moved or passed along various paths on the machine. As the spools are passed around, tensile strands extending from the spools toward a center of the machine may converge at a "braiding point" or braiding area. Braiding machines may be characterized according to various features including spool control and spool orientation. In some braiding machines, spools may be independently controlled so that each spool can travel on a variable path throughout the braiding process, hereafter referred to as "independent spool control." Other braiding machines, however, may lack independent spool control, so that each spool is constrained to travel along a fixed path around the machine. Additionally, in some braiding machines, the central axes of each spool point in a common direction so that the spool axes are all parallel, hereby referred to as an "axial configuration." In other braiding machines, the central axis of each spool is oriented toward the braiding point, for example, radially inward from the perimeter of the machine toward the braiding point, hereby referred to as a "radial configuration."

One type of braiding machine that may be utilized is a radial braiding machine or radial braider. A radial braiding machine may lack independent spool control and may therefore be configured with spools that pass in fixed paths around the perimeter of the machine. In some cases, a radial braiding machine may include spools arranged in a radial configuration. For purposes of clarity, the detailed description and the claims may use the term "radial braiding machine" to refer to any braiding machine that lacks independent spool control. The present embodiments could make use of any of the machines, devices, components, parts, mechanisms, and/or processes related to a radial braiding machine as disclosed in Dow et al., U.S. Pat. No. 7,908,956, issued Mar. 22, 2011, and titled "Machine for Alternating Tubular and Flat Braid Sections," and as disclosed in Richardson, U.S. Pat. No. 5,257,571, issued Nov. 2, 1993, and titled "Maypole Braider Having a Three Under and Three Over Braiding path," the entirety of each application being herein incorporated by reference in its entirety. These applications may be hereafter referred to as the "Radial Braiding Machine" applications.

Another type of braiding machine that may be utilized is a lace braiding machine, also known as a Jacquard or Torchon braiding machine. In a lace braiding machine, the spools may have independent spool control. Some lace braiding machines may also have axially arranged spools. The use of independent spool control may allow for the creation of braided structures, such as lace braids, that have an open and complex topology, and may include various kinds of stitches used in forming intricate braiding patterns. For purposes of clarity, the detailed description and the claims may use the term "lace braiding machine" to refer to any braiding machine that has independent spool control. The present embodiments could make use of any of the machines, devices, components, parts, mechanisms, and/or processes related to a lace braiding machine as disclosed in Ichikawa, EP Patent Number 1486601, published on Dec. 15, 2004, and titled "Torchon Lace Machine," and as disclosed in Malhere, U.S. Pat. No. 165,941, issued Jul. 27, 1875, and titled "Lace-Machine," the entirety of each application being herein incorporated by reference in its entirety. These applications may be hereafter referred to as the "Lace Braiding Machine" applications.

Spools may move in different ways according to the operation of a braiding machine. In operation, spools that are moved along a constant path of a braiding machine may be said to undergo "Non-Jacquard motions," while spools that move along variable paths of a braiding machine are said to undergo "Jacquard motions." Thus, as used herein, a lace braiding machine provides means for moving spools in Jacquard motions, while a radial braiding machine can only move spools in Non-Jacquard motions.

FIGS. 12 through 18 illustrate schematically a single braiding machine that may be used to form different braided portions with different braided patterns on a last. In some embodiments, the braiding machine may be similar to the braiding machine disclosed in Bruce et al., U.S. Patent Publication Number 2016/0345677, published on Dec. 1, 2016, and titled, "BRAIDING MACHINE AND METHOD OF FORMING AN ARTICLE INCORPORATING A MOVING OBJECT," the disclosure of which is herein incorporated by reference in its entirety. In other embodiments, the braiding machine may include a fixed last as disclosed in Bruce et al., U.S. Patent Publication Number 2016/0345676, published on Dec. 1, 2016, and titled, "BRAIDING MACHINE AND METHOD OF FORMING AN ARTICLE INCORPORATING BRAIDING MACHINE," the disclosure of which is herein incorporated by reference in its entirety.

Figure 12:
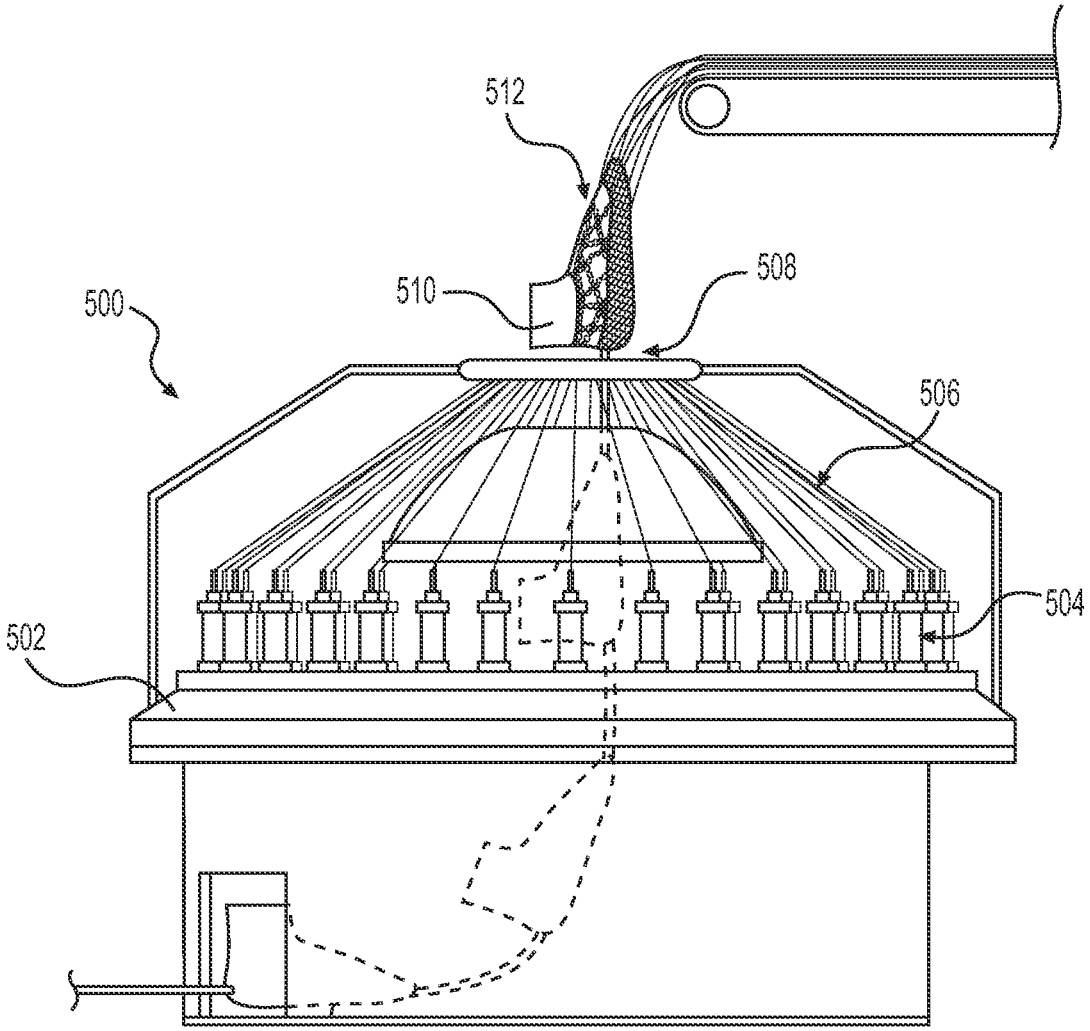
FIG. 12 is a schematic view of an embodiment of a braiding machine.

In some embodiments, braiding machine 500 may include outer frame portion 502, as shown in FIG. 12. Outer frame portion 502 may house a set of spool components or spools 504. Spools 504 may have tensile elements 506, extending from spools 504, that converge toward central braiding point 508. In some embodiments, mold or last 510 may be conveyed through central braiding point 508. In some embodiments, as last 510 is fed through central braiding point 508, tensile elements 506 may form braided structure 512 on the surface of last 510.

Figure 13:
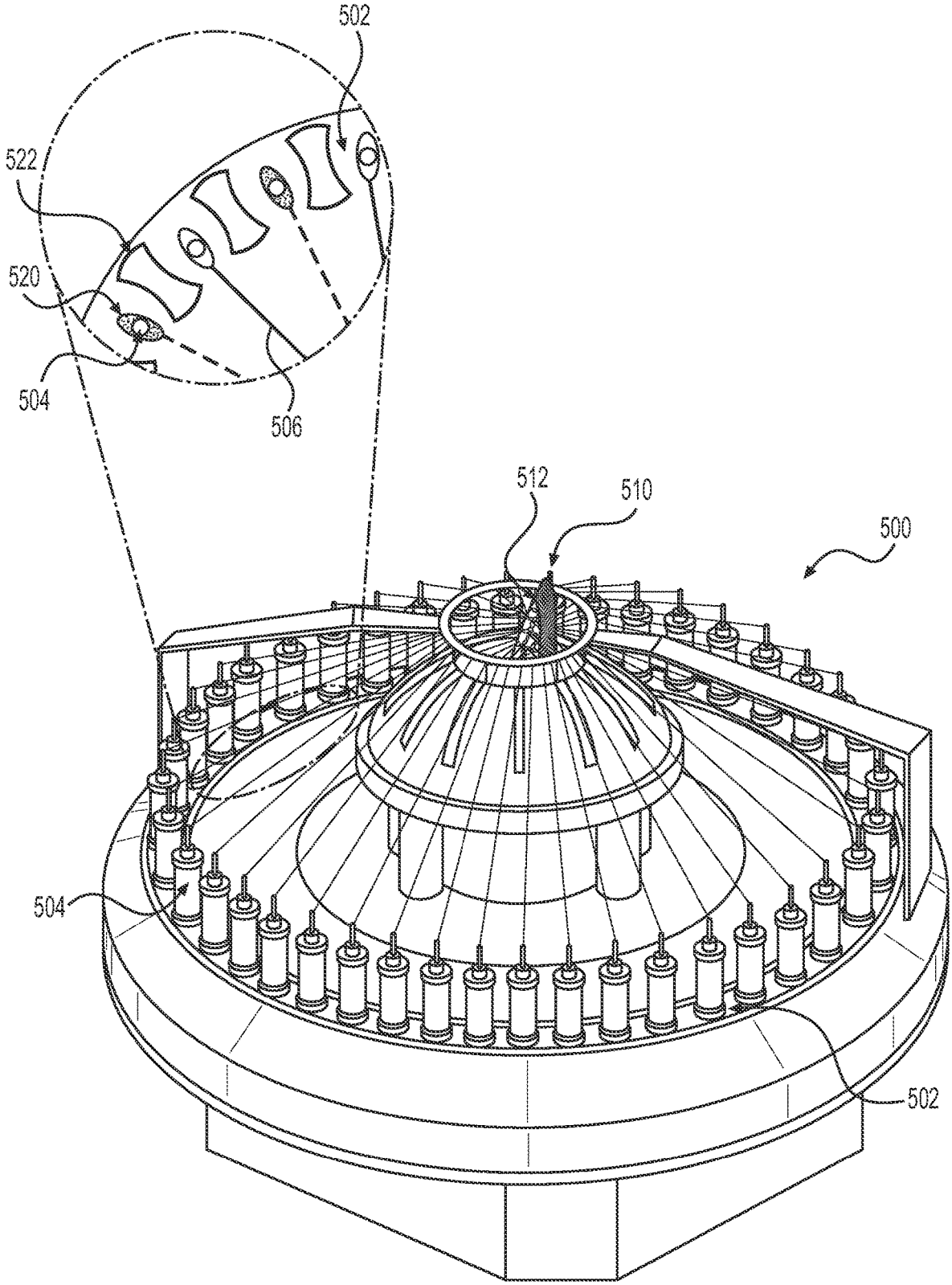
FIG. 13 is a schematic view of an embodiment of a braiding machine with an enlarged view of a section of the braiding machine.

Referring to FIG. 13, in some embodiments, braiding machine 500 may generally include spools 504 that follow various trajectories or paths along outer frame portion 502 on braiding machine 500. As shown schematically in the enlarged view of FIG. 13, in some embodiments, spools 504 may be held by spindle runners 520. During operation, spindle runners 520 may be rotated and conveyed to different positions by rotor gears 522. During operation, rotor gears 522 may rotate in either a clockwise or counterclockwise direction so that spindle runners 520 with spools 504 pass alone each other thus intertwining tensile elements 506 extending from spools 504. The intertwining of tensile elements 506 results in the forming of braided structure 512 on last 510.

Figure 14:
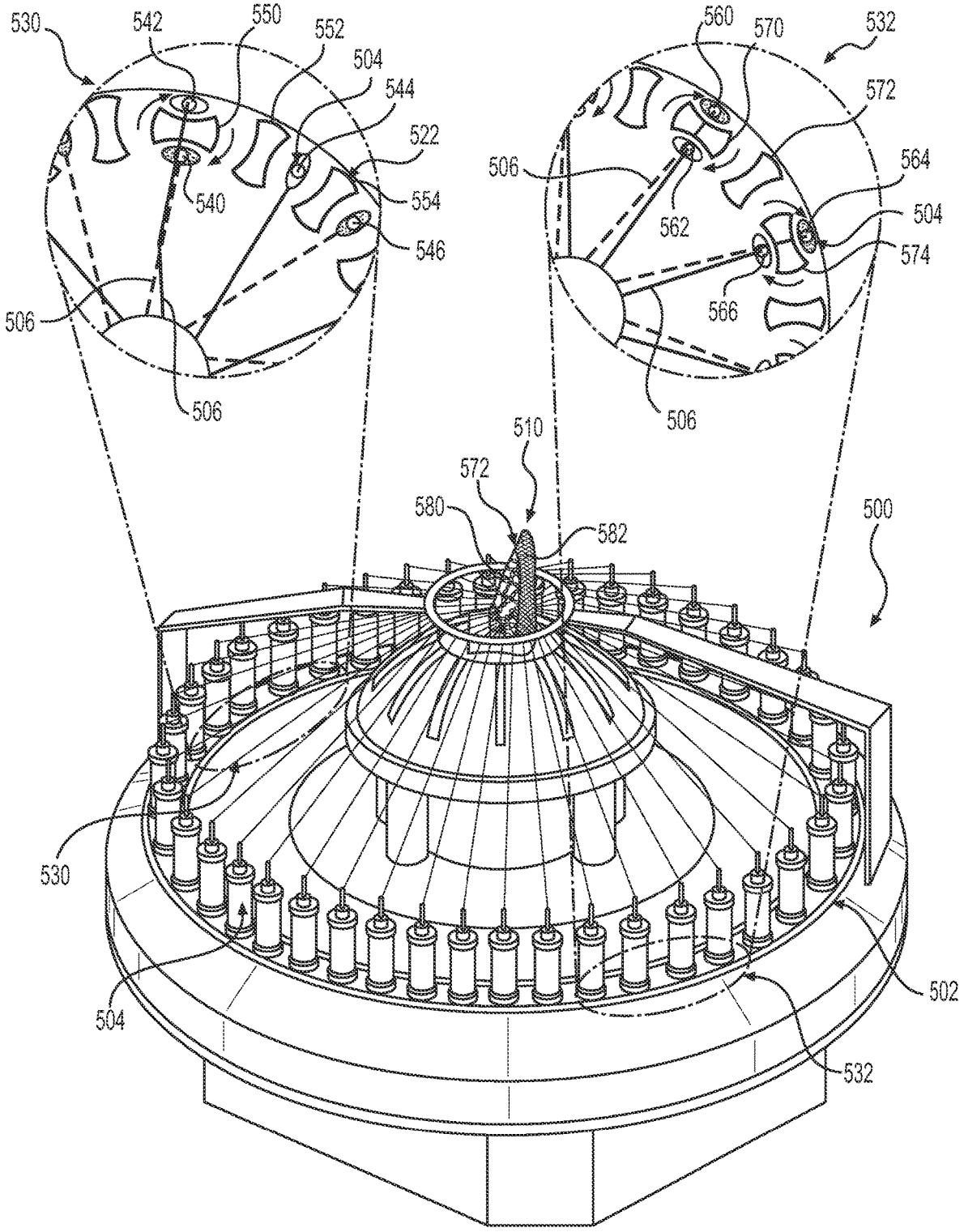
FIG. 14 is a schematic view of an embodiment of a braiding machine with enlarged views of a first section and a second section.

Some embodiments of a braiding machine may have different sections where the set of spools follow different trajectories. In other words, in some embodiments, braiding machine 500 may have sections where there is independent spool control. In some embodiments, the braiding machine may have sections that lack independent spool control. Referring to FIG. 14, in an exemplary embodiment, braiding machine 500 may have first section 530 where spools 504 follow a variable path. Accordingly, spools 504 in first section 530 may undergo a Jacquard motion. Further, braiding machine 500 may have second section 532 where spools 504 follow a constant path. With this arrangement, spools 504 may undergo a Non-Jacquard motion. It is understood that first section 530 and second section 532 are not meant to convey any specific location on braiding machine 500. Moreover, first section 530 may be any location along outer frame portion 502 of the braiding machine where spools follow a variable path with independent spool control, whereas second section 532 may be any location along outer frame portion 502 where spools follow a constant path.

The enlarged views of FIG. 14 illustrate an exemplary embodiment of braiding machine 500 where spools 504 follow variable and constant paths. In some embodiments, spools 504 in first section 530 of the braiding machine may exhibit independent spool control via rotor gears 522. During operation, first spool 540 and second spool 542 are rotated by first rotor gear 550. In contrast, third spool 544 and fourth spool 546 remain in place as second rotor gear 552 and third rotor gear 554 remain stationary. Thus, first spool 540 and second spool 542 are said to undergo a Jacquard motion. As first spool 540 and second spool 542 rotate, their respective tensile elements 506 are intertwined forming first braid portion 580 on last 510. In some embodiments, first braid portion 580 has a Jacquard braid pattern.

In different embodiments, spools 504 in first section 530 that undergo a Jacquard motion may form additional features previously mentioned on first braid portion 580. As discussed above, because spools 504 in first section 530 possess independent spool control thereby allowing spools 504 to follow variable paths, first braid portion 580 may include different textures. In addition, as spools 504 undergo a Jacquard motion in first section 530, a finished edge may be formed on first braid portion 580.

In some embodiments, braiding machine 500 may have second section 532 in which spools 504 follow a constant path during operation. In some embodiments, spools 504 in second section 532 may follow a constant path simultaneously as spools 504 in first section 530 follow a variable path. As shown, during operation, fifth spool 560 and sixth spool 562 are rotated by fourth rotor gear 570. At the same time, seventh spool 564 and eighth spool 566 are rotated by sixth rotor gear 574. Further, fifth rotor gear 572 remains stationary so as not to interfere and contact fifth spool 560, sixth spool 562, seventh spool 564, and eighth spool 566 as they are rotated. As fifth spool 560, sixth spool 562, seventh spool 564, and eighth spool 566 are rotated, their respective tensile elements 506 are intertwined forming second braid portion 582 on last 510. In some embodiments, second braid portion 582 has a Non-Jacquard braid pattern. Therefore, in an exemplary embodiment, as spools 504 in first section 530 form first braid portion 580 simultaneously as spools 504 in second section 532 form second braid portion 582 on last 510, a seamless braided structure may be formed. With this arrangement, the seamless braided structure incorporates first braid portion 580 having a Jacquard braid pattern with second braid portion 582 having a Non-Jacquard braid pattern.

FIGS. 15-18 schematically illustrate another embodiment of how a first section and a second section of a braiding machine may form a braided structure on an upper with different and distinct braid patterns.

Figure 15:
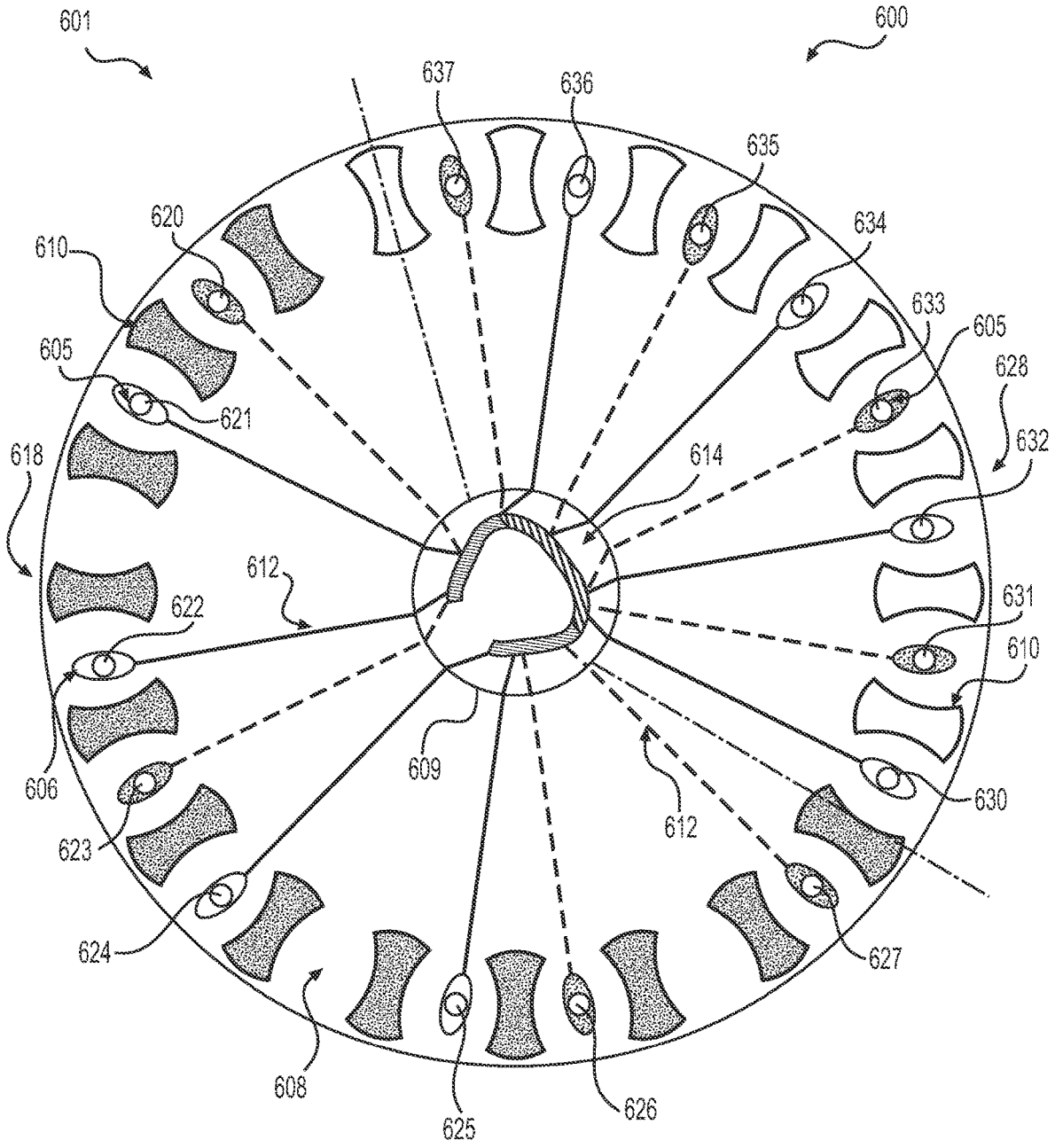
FIG. 15 is top down schematic view of an embodiment of a braiding machine with a first section and a second section.

Referring to FIG. 15, in an initial or first configuration 601, spools 605 are configured on spindle runners 606 disposed on outer portion 608 of braiding machine 600. As spools 605 are rotated by rotor gears 610, tensile elements 612 are intertwined forming braided structures 614 on a last at central braiding point 609. During operation, first spool 620, second spool 621, third spool 622, fourth spool 623, fifth spool 624, sixth spool 625, seventh spool 626, and eighth spool 627, may be traveling in first section 618. Spools 605 disposed in first section 618 may exhibit independent spool control. Accordingly, spools 605 in first section 618 may be associated with following independent or variable paths. Simultaneously during operation, spools 605 disposed in second section 628 may lack independent spool control. Accordingly, ninth spool 630, tenth spool 631, eleventh spool 632, twelfth spool 633, thirteenth spool 634, fourteenth spool 635, fifteenth spool 636, and sixteenth spool 637 may each follow a constant path. For purposes of illustration, first section 618 and second section 628 are distinguished by the shading or non-shading of rotor gears 610. Further, for purposes of illustration, spools 605 may be shaded either black or white to show their initial and subsequent relative positions on braiding machine during operation.

Figure 16:
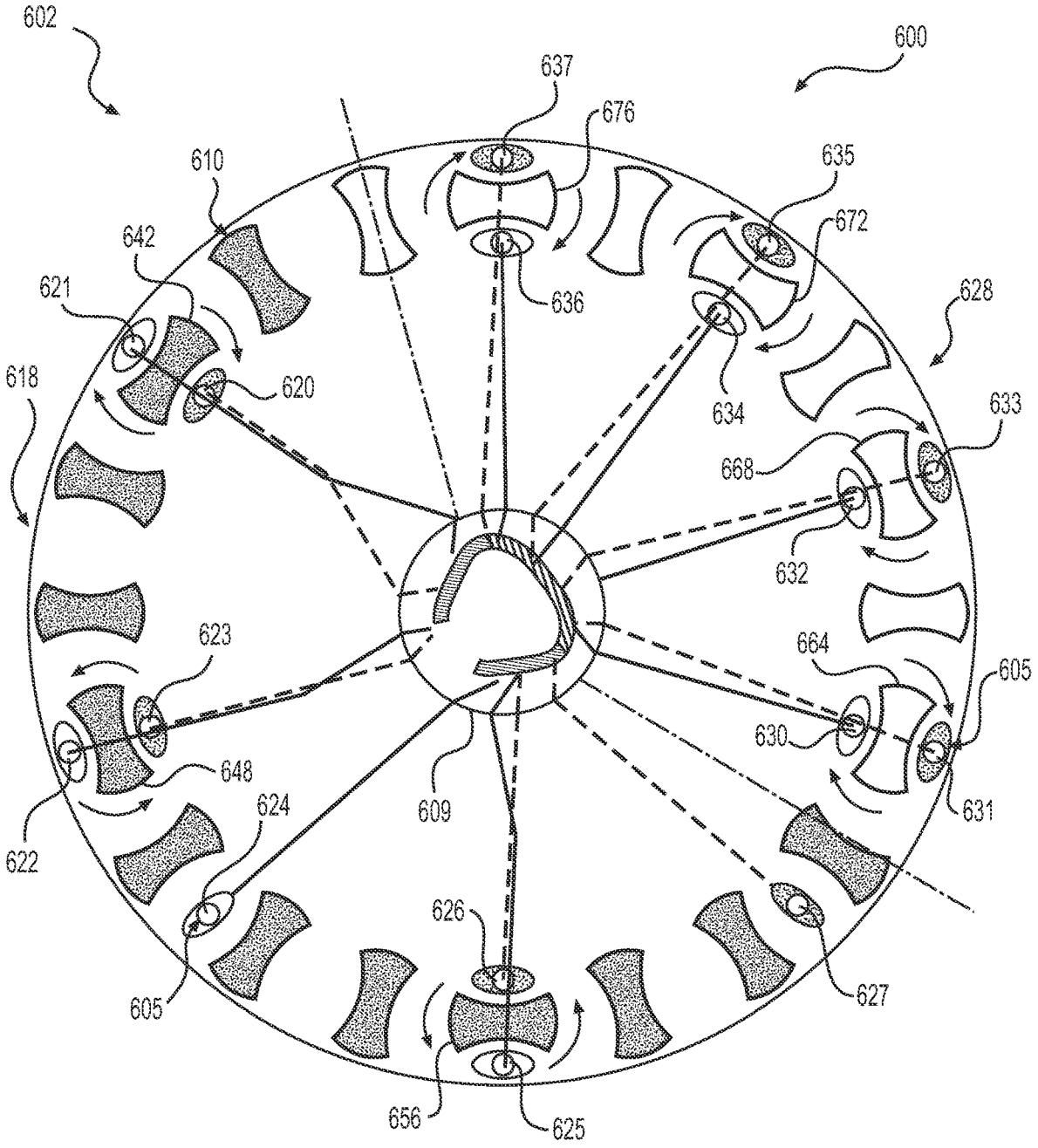
FIG. 16 is top down schematic view of an embodiment of a braiding machine depicting spool paths of a first section and a second section of the braiding machine.

Referring to FIG. 16, in forming a braided structure with a Jacquard braid pattern, spools 605 in first section 618, because they have independent spool control, may, individually, travel in either a clockwise or counterclockwise direction around the center of braiding machine 600. Additionally, other spools 605 in first section 618 may remain static and not rotate. Therefore, as shown, in second configuration 602, first spool 620 and second spool 621 are rotated by second rotor gear 642 in a clockwise direction, and third spool 622 and fourth spool 623 are rotated by fifth rotor gear 648 in a counterclockwise direction. Sixth spool 625 and seventh spool 626 are rotated in a counterclockwise direction by ninth rotor gear 656. Further, fifth spool 624 and eighth spool 627 may remain static.

In some embodiments, as spools 605 in first section 618 follow variable paths, at the same time, spools 605 in second section 628 each follow a constant path. Therefore, in second configuration 602, ninth spool 630 and tenth spool 631 are rotated by thirteenth rotor gear 664, eleventh spool 632 and twelfth spool 633 are rotated by fifteenth rotor gear 668, thirteenth spool 634 and fourteenth spool 635 are rotated by seventeenth rotor gear 672, and fifteenth spool 636 and sixteenth spool 637 are rotated by nineteenth rotor gear 676.

It is to be noted that in second configuration 602, spools 605 in second section 628 are all rotated only in a clockwise direction around the respective rotor gears 610. However, each spool in second section 628 is forced to go either in a clockwise or counterclockwise direction around the center of braiding machine 600. For example, tenth spool 631, twelfth spool 633, fourteenth spool 635, and sixteenth spool 637 may all travel in a generally clockwise direction around the center of braiding machine 600, while ninth spool 630, eleventh spool 632, thirteenth spool 634, and fifteenth spool 636 may travel in a generally counterclockwise direction around the center of braiding machine 600. In contrast, spools 605 in first section 618 may rotate, individually, in either a clockwise or counterclockwise direction around rotor gears 610, and around the center of braiding machine 600.

Figure 17:
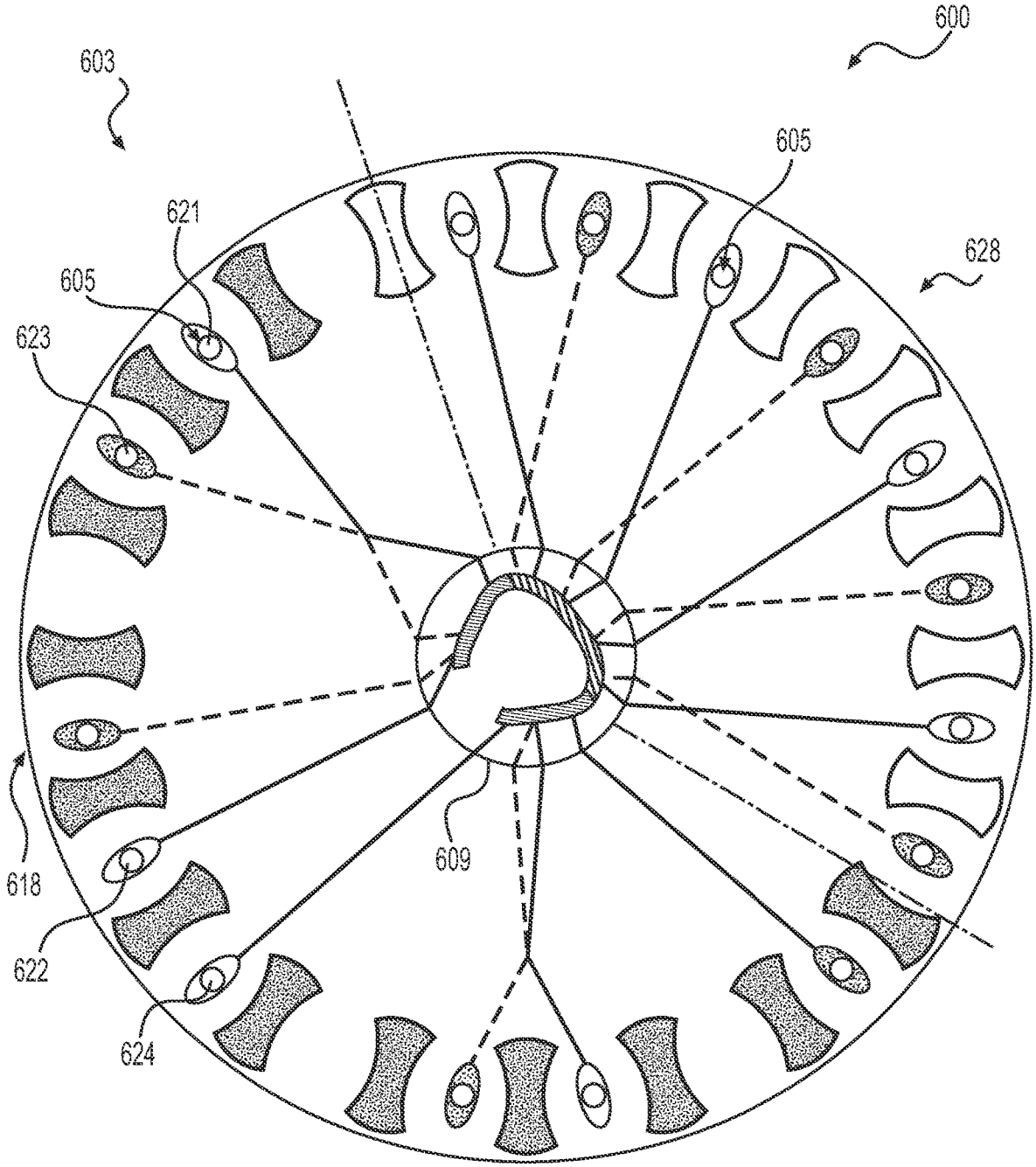
FIG. 17 is top down schematic view of an embodiment of a braiding machine with a first section and a second section.

FIG. 17 further illustrates schematically the independent spool control of first section 618, and the lack of independent spool control in second section 628. In some embodiments, after completing rotations in second configuration 602 (as shown in FIG. 16), spools 605 in first section 618, because of their ability to move independently without restrictions, may be positioned anywhere along first section 618. For example, third spool 622, after being rotated counterclockwise around the center of braiding machine 600 in second configuration 602, is positioned proximal to fifth spool 624 in third configuration 603. However in some other embodiments, third spool 622 could be rotated clockwise around the center of braiding machine 600, and therefore could be positioned proximal to first spool 620 and second spool 621 after rotation. In contrast, every other spool (e.g., shading or non-shading) in second section 628 is restricted in moving in the same direction, clockwise or counterclockwise, around the center of braiding machine 600.

Figure 18:
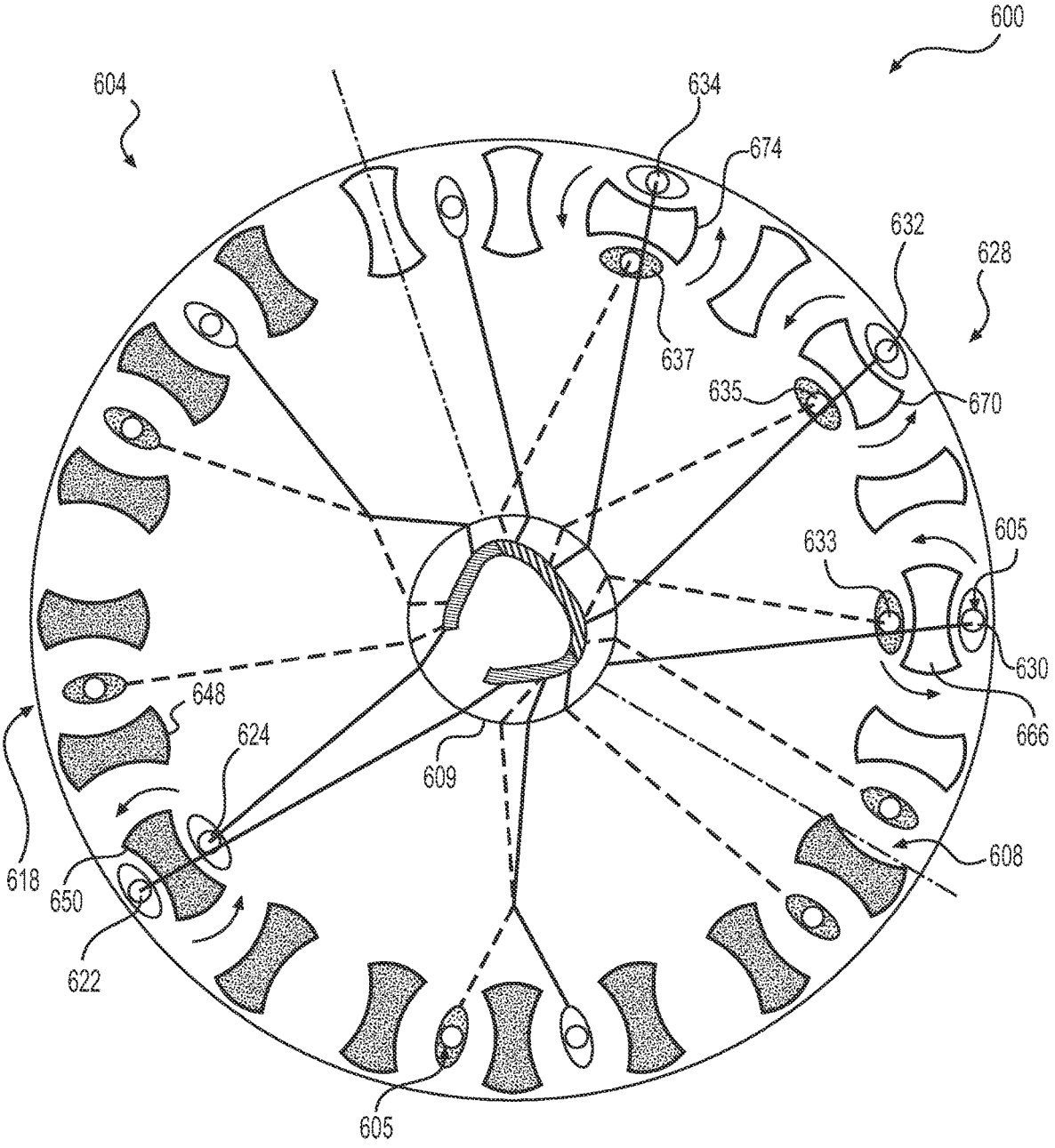
FIG. 18 is top down schematic view of an embodiment of a braiding machine depicting spool paths of a first section and a second section of the braiding machine.

Referring to FIG. 18, because of the independent spool control in first section 618, spools 605 have different options regarding their path of travel. In some embodiments, after rotating, spools 605 in first section 618 may remain in place, may be further rotated by a different rotor gear, or may be rotated again with the same rotor gear. Therefore, in fourth configuration 604, third spool 622 after being rotated by fifth rotor gear 648, may be rotated again, this time by sixth rotor gear 650, or may remain static. In one embodiment, third spool 622 and fifth spool 624 are rotated in a counterclockwise direction by sixth rotor gear 650. In some embodiments, third spool 622 may eventually traverse the entire outer portion 608 of the braiding machine so that third spool 622 may enter second section 628 and undergo a Non-Jacquard motion. In other words, spools 605 can enter first section 618 and follow a variable path, and subsequently enter second section 628 and follow a constant path.

In contrast, during fourth configuration 604, spools 605 in second section 628, because they do not have independent spool control, continue on their constant paths in either a clockwise or counterclockwise direction around the center of braiding machine 600. In one embodiment, spools 605 in second section 628 will undergo rotation by the next adjacent rotor gear. For example, ninth spool 630 and twelfth spool 633 will be rotated by fourteenth rotor gear 666, eleventh spool 632 and fourteenth spool 635 will be rotated by sixteenth rotor gear 670, thirteenth spool 634 and sixteenth spool 637 will be rotated by eighteenth rotor gear 674. In some embodiments, spools 605 in second section 628 may eventually enter first section 618 and accordingly undergo a Jacquard motion. In other words, spools 605 can enter second section 628 and follow a constant path, and subsequently enter first section 618 and follow a variable path.

While the embodiments of the figures depict articles having low collars (e.g., low-top configurations), other embodiments could have other configurations. In particular, the methods and systems described herein may be utilized to make a variety of different article configurations, including articles with higher cuff or ankle portions. For example, in another embodiment, the systems and methods discussed herein can be used to form a braided upper with a cuff that extends up a wearer's leg (i.e., above the ankle). In another embodiment, the systems and methods discussed herein can be used to form a braided upper with a cuff that extends to the knee. In still another embodiment, the systems and methods discussed herein can be used to form a braided upper with a cuff that extends above the knee. Thus, such provisions may allow for the manufacturing of boots comprised of braided structures. In some cases, articles with long cuffs could be formed by using lasts with long cuff portions (or leg portions) with a braiding machine (e.g., by using a boot last). In such cases, the last could be rotated as it is moved relative to a braiding point so that a generally round and narrow cross-section of the last is always presented at the braiding point.

While various embodiments of the invention have been described, the description is intended to be exemplary, rather than limiting, and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of making an article of footwear, comprising:

providing a set of spools configured with a set of tensile elements;

providing a braiding machine having a first section and a second section;

wherein the braiding machine is configured with the set of spools;

passing a last through a braiding point, the braiding point being a region where the set of tensile elements converge, thereby forming a seamless braided structure on the last;

moving the set of spools through the first section to form a first braid portion of the seamless braided structure;

moving the set of spools through the second section to form a second braid portion of the seamless braided structure;

wherein a set of rotor gears move the set of spools in a Jacquard motion in the first section; and wherein the set of rotor gears move the set of spools in a Non-Jacquard motion in the second section.

2. The method of claim 1, further including forming a Jacquard braid pattern in the first braid portion.

3. The method of claim 2, further including forming a Non-Jacquard braid pattern in the second braid portion.

4. The method of claim 2, further including forming the first braid portion with a first texture and a second texture, and wherein the first texture is different than the second texture.

5. The method of claim 1, further including forming a finished edge in the first braid portion.

* * * * *